US007840156B2

(12) United States Patent
Inaba

(10) Patent No.: US 7,840,156 B2
(45) Date of Patent: Nov. 23, 2010

(54) ELECTROPHOTOGRAPHIC IMAGE FORMING APPARATUS AND CARTRIDGE SUPPORT MEMBER

(75) Inventor: Yuuichirou Inaba, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 12/372,364

(22) Filed: Feb. 17, 2009

(65) Prior Publication Data

US 2010/0098452 A1 Apr. 22, 2010

(30) Foreign Application Priority Data

Oct. 17, 2008 (JP) ..... 2008-268978

(51) Int. Cl.
*G03G 21/20* (2006.01)
*G03G 15/01* (2006.01)
*G03G 21/18* (2006.01)

(52) U.S. Cl. ..... 399/92; 399/112

(58) Field of Classification Search ..... 399/92, 399/110, 111, 112
See application file for complete search history.

(56) References Cited

U.S. PATENT DOCUMENTS 6,308,024 B1 * 10/2001 Nakayama et al. ..... 399/92 X
2007/0071484 A1 * 3/2007 Igarashi ..... 399/92
2007/0146739 A1 6/2007 Igarashi ..... 358/1.7
2007/0160384 A1 7/2007 Sakurai et al. ..... 399/110

FOREIGN PATENT DOCUMENTS

| | | |
|---|---|---|
| JP | 2000-238320 | 9/2000 |
| JP | 2005-37704 | 2/2005 |
| JP | 2007-178608 | 7/2007 |
| JP | 2007-213033 | 8/2007 |

* cited by examiner

*Primary Examiner*—Sophia S Chen
(74) *Attorney, Agent, or Firm*—Fitzpatrick, Cella, Harper & Scinto

(57) ABSTRACT

An electrophotographic image forming apparatus includes a main frame, and a tray being movable between an inner side position located inside of the main frame and an outer side position located outside of the main frame while supporting process cartridges. The tray has, in its interior, hollow portions through which outside air passes, an inlet that introduces the outside air into the hollow portions, and outlets through which the outside air introduced into the hollow portions is discharged so as to impinge on the process cartridges.

9 Claims, 18 Drawing Sheets

ELECTROPHOTOGRAPHIC IMAGE FORMING APPARATUS AND CARTRIDGE SUPPORT MEMBER

BACKGROUND OF THE INVENTION

1. Field of the Invention

The present invention relates to an electrophotographic image forming apparatus and a cartridge support member in which a process cartridge is detachably mounted to an apparatus main body.

2. Description of the Related Art

As used here, an electrophotographic image forming apparatus forms an image on a recording medium by using an electrophotographic image forming method. Examples of the electrophotographic image forming apparatus include electrophotographic copiers, electrophotographic printers (e.g., laser beam printers, LED printers, etc.), facsimile machines, word processors, and so on. Here, note that the recording medium is an object on which an image is formed by using the above-mentioned electrophotographic image forming method. The above-mentioned recording medium is, for example, paper, a plastic sheet, an OHP sheet, etc.

In addition, the process cartridge has a process unit, which includes at least one of a charging means, a developing means and a cleaning means, and an electrophotographic photosensitive drum formed into a cartridge in an integrated manner, so that it is adapted to be detachably mounted to a main body of the electrophotographic image forming apparatus. Accordingly, the process cartridge includes one in which a development means as a process unit and an electrophotographic photosensitive drum are formed into a cartridge in an integrated manner so that it is detachably mounted to the main body of the electrophotographic image forming apparatus. Further, the process cartridge includes another one in which a charging means, a development means or a cleaning means as a process unit and an electrophotographic photosensitive drum are formed into a cartridge in an integrated manner so that it is detachably mounted to the main body of the electrophotographic image forming apparatus. Here, since the above-mentioned process cartridge can be easily attached to and detached from the apparatus main body by a user himself or herself, it is possible to perform the maintenance of the apparatus main body in an easy manner. In this regard, note that the above-mentioned process unit acts on the electrophotographic photosensitive drum.

Here, it is generally considered that the temperature inside the cartridge is controlled not to become too high so as to prevent deterioration in quality of the process cartridge (hereinafter referred to simply as a cartridge). Specifically, in case where a developer (toner) is contained in the cartridge, it is necessary to avoid the temperature of the developer from exceeding its melting point for the purpose of preventing the melting and/or fusion of the developer. Also, in the case where there is a member composed of a rubber material in a part provided within the cartridge, it is necessary to prevent the part from softening due to a rise in the temperature thereof. Here, note that as a representative example of the member composed of a rubber material, there is exemplified a cleaning blade that removes a residual toner on a surface of an electrophotographic photosensitive member.

Accordingly, in the past, there has been known a technique in which a ventilation channel for sending outside air into the apparatus main body or a fan for blowing air into the apparatus main body in a forced manner is arranged in the apparatus main body in order to cool the cartridge. However, in general, such a cartridge might sometimes be arranged in a position where air ventilation is relatively poor in the apparatus main body for the reason that a variety of kinds of component parts have to be arranged in the surroundings of the cartridge.

Accordingly, a special duct sometimes has to be arranged for guiding outside air from a frame side of the apparatus main body up to the position of the cartridge. However, a plurality of parts generally exist in the vicinity of the cartridge, as stated above, and it might be difficult to ensure a route for guiding the outside air. Therefore, it has sometimes been necessary to ensure a space for arrangement of such a special duct, or to use a duct of a complex shape or geometric structure.

Thus, in the past, there has been used the special duct or the like, for blowing outside air into the cartridge, so the number of parts required is increased, giving rise to an impediment to making the apparatus compact and small in size. In addition, the need for the special duct or the like has resulted in the cause of a cost increase in the apparatus.

Here, note that as a relevant technique, there is one disclosed in Japanese patent application laid-open No. 2005-37704.

SUMMARY OF THE INVENTION

An object of the present invention is to provide an electrophotographic image forming apparatus and a cartridge support member which can cool a cartridge in an effective manner.

Another object of the present invention is to provide an electrophotographic image forming apparatus and a cartridge support member which can cool a cartridge in an effective manner without increasing the number of component parts required.

A further object of the present invention is to provide an electrophotographic image forming apparatus in which a cartridge support member, being movable between an inner side position and an outer side position of an apparatus main body while supporting a cartridge, is able to be used for cooling the cartridge. In addition, a still further object of the present invention is to provide the above-mentioned cartridge support member.

According to one aspect of the present invention, there is provided an electrophotographic image forming apparatus in which a process cartridge having an electrophotographic photosensitive drum and a process unit acting on the electrophotographic photosensitive drum is detachably mounted to an apparatus main body, so that an image is formed on a recording medium, the apparatus including:

a cartridge support member being movable between an inner side position located inside of the apparatus main body and an outer side position located outside of the apparatus main body while supporting the process cartridge;

wherein the cartridge support member has, in its interior, a first ventilation channel through which outside air passes, an inlet that introduces the outside air into the first ventilation channel, and an outlet through which the outside air introduced into the first ventilation channel is discharged so as to impinge on the process cartridge.

According to another aspect of the present invention, there is provided cartridge support member for use in an electrophotographic image forming apparatus in which a process cartridge is detachably mounted to an apparatus main body and having an electrophotographic photosensitive drum and a process unit acting on said electrophotographic photosensitive drum, so that an image is formed on a recording medium, wherein the cartridge support member has, in its interior, a first ventilation channel through which outside air passes, an inlet that introduces the outside air into the first ventilation channel, and an outlet through which the outside air introduced into the first ventilation channel is discharged so as to impinge on the process cartridge; and the cartridge support member is movable between an inner side position located inside of the apparatus main body and an outer side position located outside of the apparatus main body while supporting the process cartridge.

According to the present invention, the cartridge can be cooled in an effective manner.

According to the present invention, the cartridge can be cooled in an effective manner without increasing the number of component parts required.

According to the present invention, the cartridge support member, being movable between the inner side position and the outer side position of the apparatus main body while supporting the cartridge, is able to be used for cooling the cartridge.

The above and other objects, features and advantages of the present invention will become more readily apparent to those skilled in the art from the following detailed description of preferred embodiments of the present invention taken in conjunction with the accompanying drawings.

DESCRIPTION OF THE EMBODIMENTS

In the following, the best mode for carrying out the present invention will be described in detail by way of example based on the following embodiments of the present invention while referring to the accompanying drawings. However, it is to be understood that the measurements, materials, shapes, relative arrangements and the like of component parts described in the embodiments should not be construed as limiting the scope of the present invention in any manner, in particular unless specified otherwise.

As described above, the present invention relates to an electrophotographic image forming apparatus in which a cartridge is detachably mounted to a main body of the apparatus, and also to a cartridge support member which is used in the electrophotographic image forming apparatus. In the embodiment to be described below, reference will be made to the case of a full color laser printer as one example of a full color electrophotographic image forming apparatus.

Embodiment 1

Now, reference will be made to a color electrophotographic image forming apparatus 100 (hereinafter referred to simply as an image forming apparatus) and a cartridge tray 35 (cartridge support member) according to a first embodiment of the present invention, while referring to the FIG. 1 through FIG. 21. In the following description, a forward side (front side) with respect to the image forming apparatus 100 (or an apparatus main body 100*a*) is a side at which an opening and closing door (opening and closing member) 31 of the apparatus 100 is arranged. Also, a rear side with respect to the image forming apparatus 100 is a side opposite to this forward side. In addition, a front and rear direction are respectively a direction (i.e., a forward direction) from the rear side to the forward side of the apparatus main body 100*a*, and an opposite direction thereof (i.e., a rearward direction). Further, the terms "left" and "right" are, respectively, the left and the right when the apparatus main body 100*a* is seen from the forward side. The right and left directions, are, respectively, a direction (i.e., a left direction) from the right to the left, and an opposite direction thereof (i.e., a right direction). Here, note that the apparatus main body 100*a* is the image forming apparatus 100 with a cartridge P excluded therefrom.

<Construction of the Entire Image Forming Apparatus>

Figure 1:
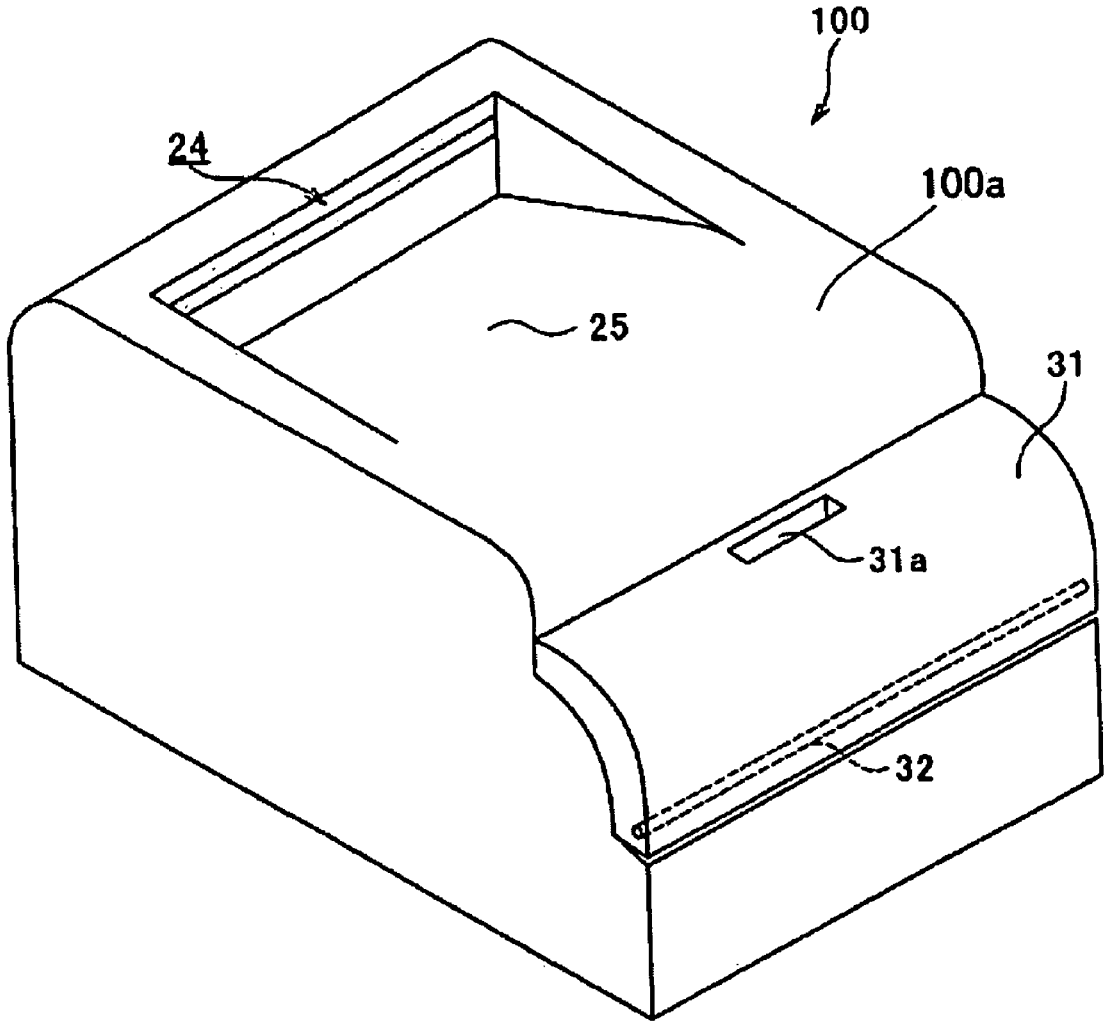
FIG. 1 is an external perspective view of an image forming apparatus according to an embodiment of the present invention.
Figure 2:
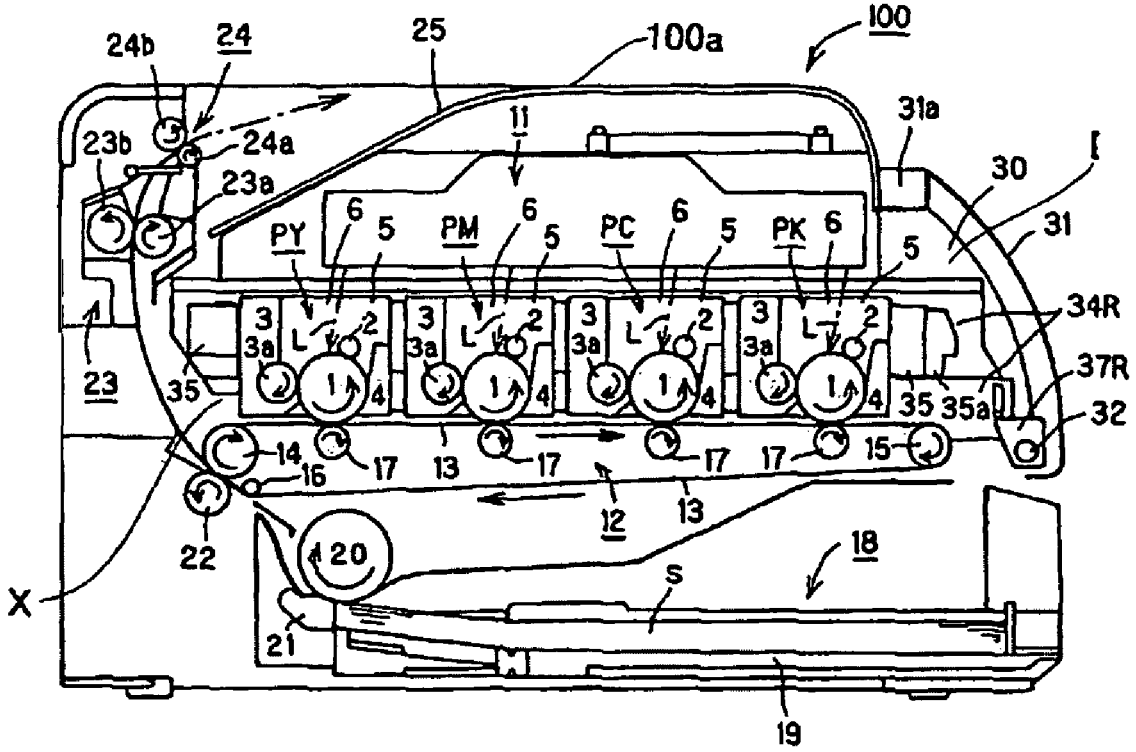
FIG. 2 is a schematic cross sectional view of the image forming apparatus and a cartridge support member according to the embodiment of the present invention.

The entire construction of the image forming apparatus according to the embodiment of the present invention will be described, while referring to FIG. 1 and FIG. 2. FIG. 1 is an external perspective view showing the construction of the image forming apparatus 100 according to the embodiment of the present invention. FIG. 2 is a schematic cross sectional view of the image forming apparatus 100 according to the embodiment of the present invention. Here, note that FIG. 2 is the schematic cross sectional view of the image forming apparatus 100, as seen from the left side thereof, in a state thereof being cut in the front and rear direction.

The image forming apparatus 100 according to this embodiment is a four-color full-color laser printer that uses an electrophotographic image forming process. This image forming apparatus 100 is an apparatus that performs image formation on a recording medium (e.g., paper, etc.) based on an electrical signal that is input thereto from an external host apparatus (not shown), such as a personal computer, an image reader, a counterpart facsimile machine, and so on.

In the apparatus main body 100*a*, four cartridges P (PY, PM, PC, PK) (FIG. 13) are arranged in a horizontal direction from the rear side to the front side thereof (generally called an in-line construction or a tandem construction). These individual cartridges P are the same in their basic construction and only differ from one another with respect to the colors of developer (toners) contained therein.

More specifically, each cartridge P is constructed such that an electrophotographic photosensitive drum (hereinafter referred to as a photosensitive drum 1) and a process unit, which acts on the photosensitive drum 1, are integrally assembled with each other in the interior of a cartridge frame 5. Here, each process unit serves to act on the photosensitive drum 1. Each process unit includes, for example, a charging means (charging unit) 2, a developing means (developing unit) 3, and a cleaning means (cleaning unit) 4. The charging means 2 in this embodiment is a contact charge roller. In addition, the developing means 3 is constructed such that a developing roller 3*a* is arranged in a developing container in which a developer (toner) is contained. As the cleaning means 4, there is adopted a blade type cleaning means in this embodiment.

A rearmost (back side) cartridge PY in the apparatus main body 100*a* contains therein a yellow developer (hereinafter referred to as a Y color) in the developing container in a first developing means 3, and serves to form a Y color developer image on the surface of the photosensitive drum 1. A next cartridge PM adjacent to the rearmost PY cartridge contains therein a magenta developer (hereinafter referred to as an M color) in the developing container in a second developing means 3, and serves to form an M color developer image on the surface of the photosensitive drum 1. A cartridge PC adjacent to the PM cartridge contains therein a cyanogen developer (hereinafter referred to as a C color) in the developing container in a third developing means 3, and serves to form a C color developer image on the surface of the photosensitive drum 1. A frontmost cartridge PK adjacent to the PC cartridge contains therein a black developer (hereinafter referred to as a K color) in the developing container in a fourth developing means 3, and serves to form a K color developer image on the surface of the photosensitive drum 1.

Here, the individual cartridges P are pushed into the apparatus main body 100*a* by a user while being supported on a cartridge tray (cartridge support member) 35 to be described later, and they are located in their image forming operation position X (in a state shown in FIG. 2). A laser scanner unit (hereinafter referred to as a scanner unit 11) is arranged in a position above the cartridges PY, PM, PC, PK located in the image forming operation position X. The scanner unit 11 outputs laser beams L that have been modulated corresponding to the image information of individual colors, respectively, inputted from the external host apparatus (not shown). The laser beams L outputted from the scanner unit 11 are scanned and exposed on the surfaces of the photosensitive drums 1 arranged in the individual cartridges P, respectively, while passing through exposure windows 6 (for details, see FIG. 13 and FIG. 14 to be described later) formed in the upper surfaces of the individual cartridge frames 5, respectively. Here, note that the image forming operation position X is a position in which the cartridges P perform the image formation processes. In addition, the image forming operation position X is also a position in which the photosensitive drum 1 contacts an endless belt 13 (member to be transferred) to be describes later.

An intermediate transfer belt unit 12 is arranged in a position below the cartridges PY, PM, PC, PK located in the image forming operation position X. The belt unit 12 is provided with a transfer member in the form of the endless belt 13, which is made of a dielectric material and has flexibility, and a roller unit including a drive roller 14, a turn roller 15 and a tension roller 16, which cooperate with one another to drive the endless belt 13 in a circulating manner. The drive roller 14 and the tension roller 16 are arranged at a rear (back) side in the apparatus main body 100*a*. In addition, the turn roller 15 is arranged at a front (forward) side in the apparatus main body 100*a*.

When each cartridge P is in a state located in the image forming operation position X, the photosensitive drum 1 of each cartridge P is arranged in such a manner that its lower surface is placed in contact with an upper surface of the belt 13. Also, on an inner peripheral side of the belt 13, a primary transfer roller 17 is arranged in opposition to the photosensitive drum 1 of each cartridge P with a belt portion of the belt 13 being interposed therebetween. In addition, on an outer peripheral side of the belt 13, a secondary transfer roller 22 is arranged in a position opposing the drive roller 14 through the belt portion of the belt 13. The belt 13 is driven to move in a circulating manner while being clamped between the photosensitive drum 1 and the primary transfer roller 17, and between the drive roller 14 and the secondary transfer roller 22.

A feed unit 18 is arranged at a location below the belt unit 12. The feed unit 18 has a feed tray 19 capable of carrying thereon a plurality of sheets of paper S (recording medium), a feed roller 20 for feeding out the sheets of paper S carried on the tray 19, a separation pad 21 for separating stacked sheets of paper from one another into individual separate sheets, and so on. The tray 19 is constructed so that it can be put into and out of the front side of the apparatus main body 100*a* (a side in which the door 31 is arranged) (so-called front loading type).

A fixing unit 23 for fixing the developer image transferred onto a paper sheet S and a discharge roller pair 24 for discharging a paper sheet S with the image formed thereon by the developer are arranged at a rear upper portion in the apparatus main body 100*a*. In this embodiment, as the fixing unit 23, there is used one having a fixing film assembly 23*a* and a pressure roller 23*b*. In addition, the discharge roller pair 24 are comprised of a discharge roller 24*a* and a discharge roller 24*b*. Here, note that an upper surface of the apparatus main body 100*a* is constituted by a top cover having a discharge tray 25.

Here, note that an upper surface of each cartridge P, which is in a state attached to an attachment position (image forming operation position X) in the apparatus main body 100*a*, is pressed by a presser member 42 (see FIG. 7), so that it is positioned to a prescribed positioning portion. At this time, a drive output portion of the apparatus main body 100*a* is coupled with a drive input portion of each cartridge P. Also, at this time, each cartridge has an electrical contact electrically connected to an electrical power feeding portion on the side of the apparatus main body 100*a*. Here, the presser members 42 serve to resiliently press the individual cartridges P, respectively, by the resilient force of a spring member (not shown). The presser members 42 resiliently press the individual cartridges P, respectively, in association with the closing operation of the door 31. On the other hand, the presser members 42 are moved away from the position of pressing the individual cartridges P, respectively, in association with an opening operation of the door 31. In this regard, an explanation about the detailed construction thereof is omitted.

<Image Forming Operation by the Image Forming Apparatus>

Reference will be made to the operation of the image forming apparatus 100 upon forming a full color image. In the image forming operation, the photosensitive drum 1 of each cartridge P is driven in a counterclockwise direction (indicated by an arrow in FIG. 2) to rotate at a prescribed controlled speed. In addition, in the image forming operation, the endless belt 13 is also driven to rotate in a clockwise direction (indicated by an arrow in FIG. 2) at a speed corresponding to the speed of the photosensitive drum 1.

When the image forming operation starts, the scanner unit 11 is driven to operate, and in each cartridge P, the surface of the photosensitive drum 1 thereof is uniformly charged to a prescribed polarity and potential at predetermined control timing by charging means 2 so as to synchronize with the operation of the scanner unit 11. The scanner unit 11 exposes the surfaces of the individual photosensitive drums 1 while scanning them by laser beams L which have been modulated in accordance with individual color image signals, respectively. As a result, electrostatic latent images corresponding to the corresponding color image signals are formed on the surfaces of the individual photosensitive drums 1, respectively. Then, the electrostatic latent images thus formed are developed by the developing rollers 3*a* of the developing means 3, respectively. As a result, the developer images are formed on the surface of the individual photosensitive drums 1.

According to the above-mentioned electrophotographic image forming process operation, a developer image of Y color, corresponding to a yellow component of the full color image, is formed on the photosensitive drum 1 of the cartridge PY. This developer image thus formed is primarily transferred onto the endless belt 13 by the primary transfer roller 17.

Similarly, a developer image of M color corresponding to a magenta component of the full color image, is formed on the photosensitive drum 1 of the cartridge PM. This developer image thus formed is primarily transferred onto the endless belt 13 by the primary transfer roller 17 in such a manner that it is superposed on the developer image of Y color which has already been transferred thereon.

Similarly, a developer image of C color, corresponding to a cyanogen component of the full color image, is formed on the photosensitive drum 1 of the cartridge PC. This developer image is primarily transferred onto the endless belt 13 by the primary transfer roller 17 in such a manner that it is superposed on the developer image of Y color and the developer image of M color which have already been transferred thereon.

Similarly, a developer image of K color, corresponding to a black component of the full color image, is formed on the photosensitive drum 1 of the cartridge PC. This developer image thus formed is primarily transferred onto the endless belt 13 by the primary transfer roller 17 in such a manner that it is superposed on the developer image of Y color, the developer image of M color, and the developer image of C color which have already been transferred thereon.

As described above, unfixed developer images of four colors comprising full-color images including Y color, M color, C color and K color are formed on the endless belt 13. Here, note that in the individual cartridges, the developer remaining on the surfaces of the individual photosensitive drums 1 after the primary transfer are removed by the individual cleaning means 4, respectively.

On the other hand, the feed roller 20 is also driven to rotate at predetermined control timing so that its rotation is synchronized with the operation of the scanner unit 11 or the like. As a result, the paper sheets S loaded on the feed tray 19 are fed while being separated one by one by the collaboration of the feed roller 20 and the separation pad 21. The paper sheets S thus fed are sent to a nip portion (secondary transfer nip portion) between the secondary transfer roller 22 and the endless belt 13. As a result, in the process of the conveyance of the paper sheets S while being clamped by the nip portion, the developer images comprising the superposition of four colors on the endless belt 13 are transferred to the surface of each of the paper sheets S.

The paper sheets S having passed through the nip portion are sent to the fixing unit 23, where they are heated and subjected to pressure by a fixing nip portion. As a result, the developer images of individual colors are fixed to the paper sheets S while being mixed with one another, whereby a full color image is formed on each of the paper sheets S. The paper sheets S with the full color image formed thereon pass through the fixing unit 23, and are discharged onto the discharge tray 25 by the discharge roller pair 24.

Here, note that in this embodiment, the developer remaining on the surface of the endless belt 13 without being transferred to the paper sheets S are adhered by static electricity to the surface of the photosensitive drum 1 in a primary transfer portion of the cartridge PY, for example, and are removed by the cleaning means 4 therein.

<Cartridge Replacement Method>

Next, reference will be made to a method for replacing a cartridge P in the image forming apparatus 100 while referring to FIG. 1 through FIG. 11.

<Brief Description of Cartridge Replacement Method>

Figure 3:
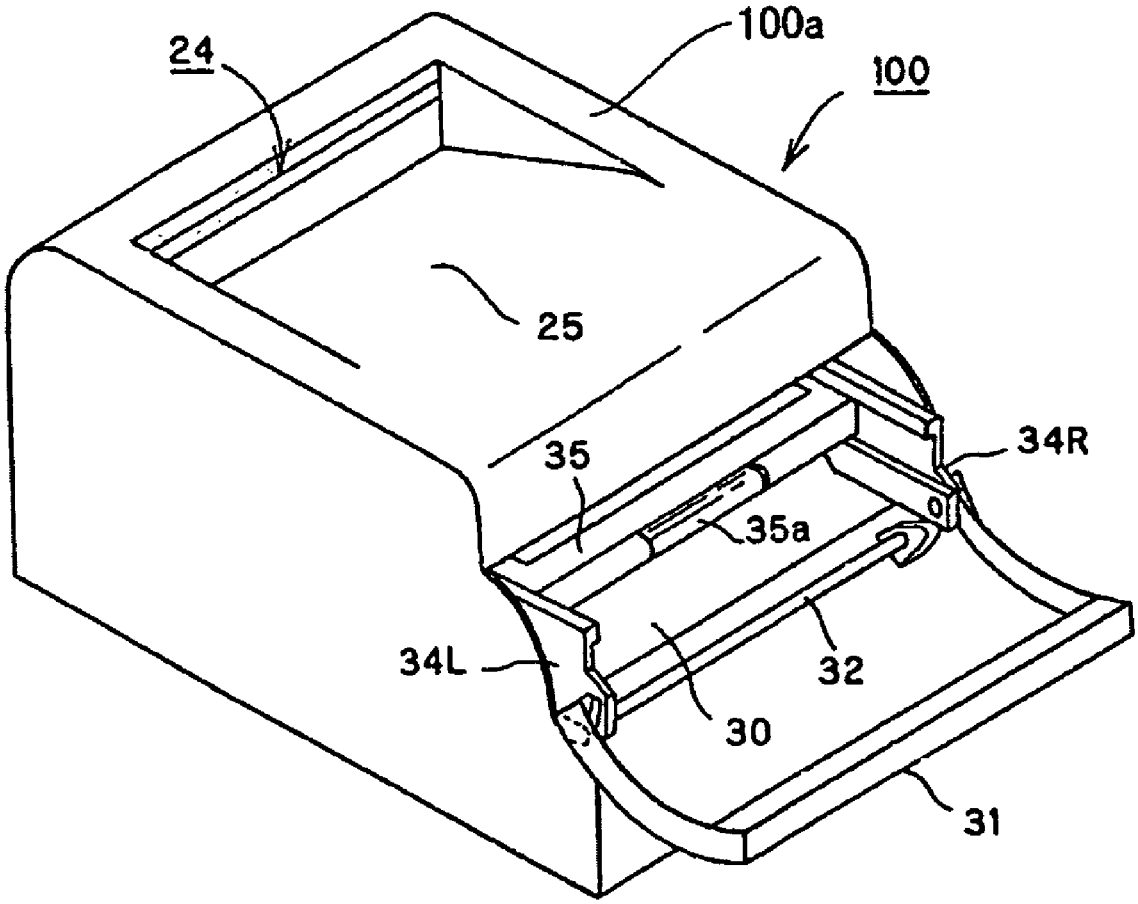
FIG. 3 is an external perspective view of the image forming apparatus according to the embodiment of the present invention.
Figure 4:
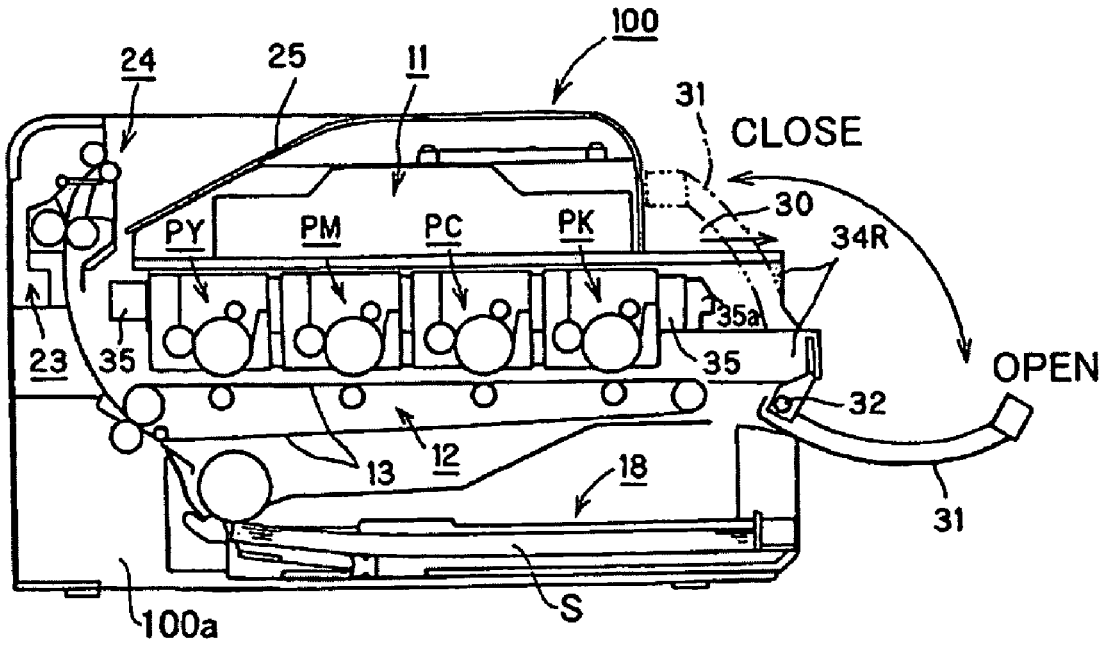
FIG. 4 is a schematic cross sectional view of the image forming apparatus and the cartridge support member according to the embodiment of the present invention.
Figure 5:
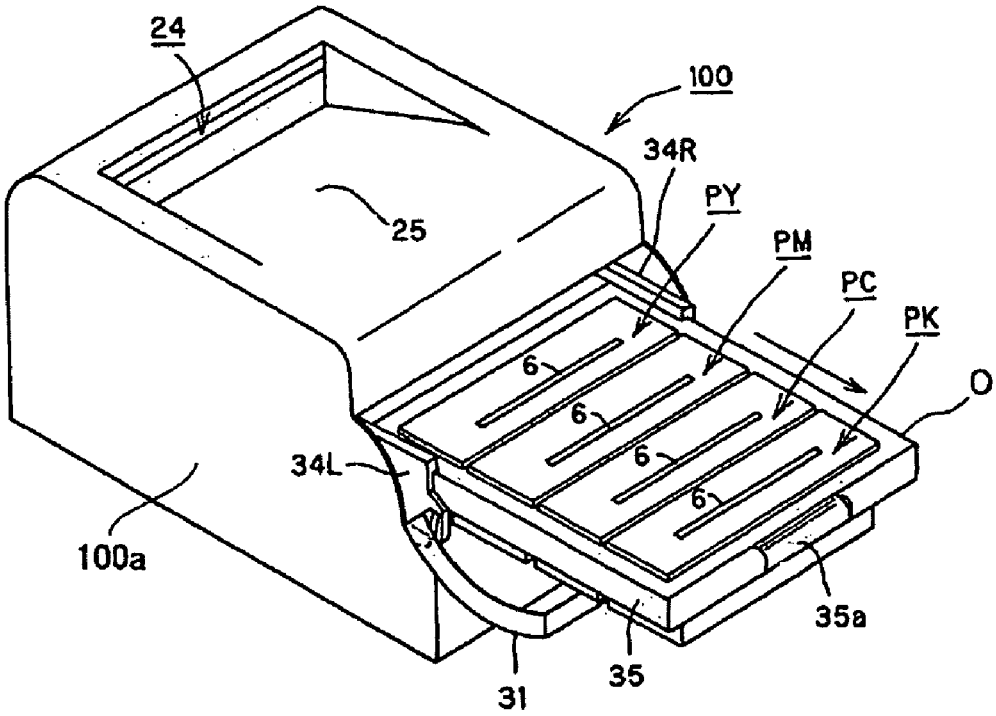
FIG. 5 is an external perspective view of the image forming apparatus and the cartridge support member according to the embodiment of the present invention.
Figure 6:
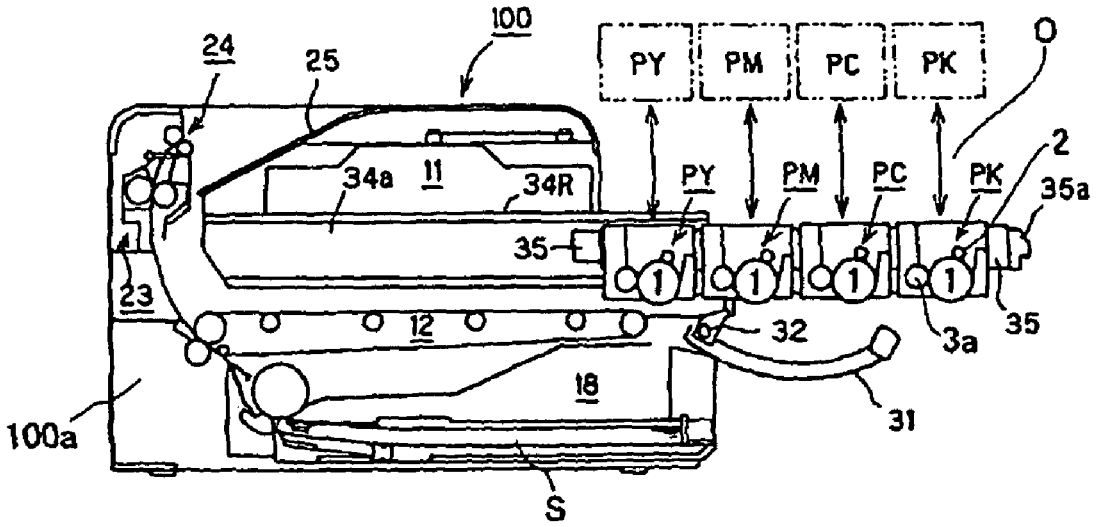
FIG. 6 is a schematic cross sectional view of the image forming apparatus and the cartridge support member according to the embodiment of the present invention.
Figure 7:
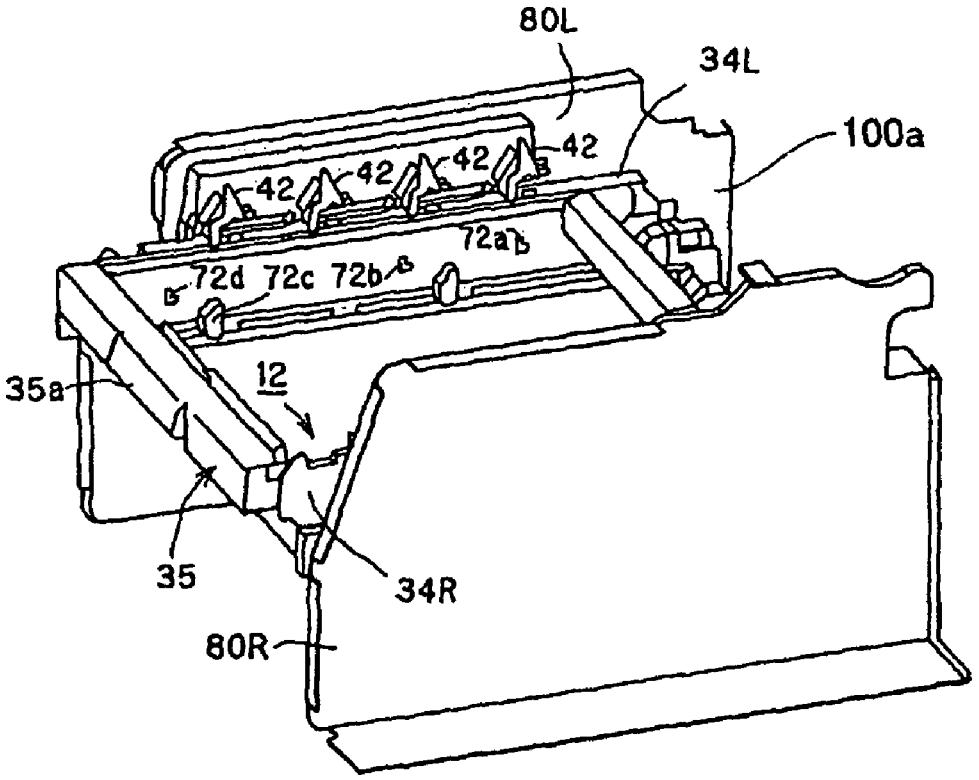
FIG. 7 is a perspective view showing the assembly structure of a main body frame and a cartridge tray (cartridge support member) in the image forming apparatus according to the embodiment of the present invention.
Figure 8:
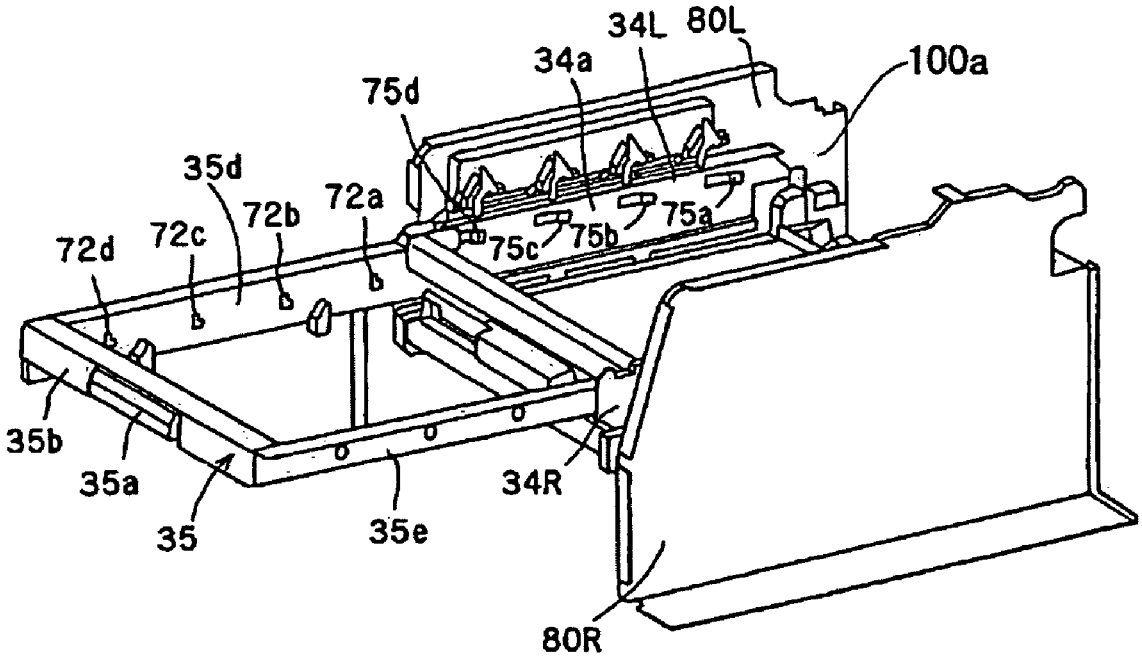
FIG. 8 is another perspective view showing the assembly structure of the main body frame and the cartridge tray (cartridge support member) in the image forming apparatus according to the embodiment of the present invention.

First of all, in particular, a description will be provided of the cartridge replacement method while referring to FIG. 1 through FIG. 8. FIG. 1, FIG. 3 and FIG. 5 are external perspective views showing the construction of the image forming apparatus 100 in its different operating states, respectively. Here, FIG. 1 shows a state in which the door (opening and closing member) 31 is in a closed state, FIG. 3 shows a state in which the door 31 is in an opened state, and FIG. 5 shows a state in which a user opens the door 31 and draws out the cartridge tray (cartridge support member) 35 from the apparatus main body 100*a*. FIG. 2, FIG. 4 and FIG. 6 are schematic cross sectional views of the image forming apparatus 100 in its different operating states, respectively. Here, FIG. 2 shows a state in which the door 31 is in a closed state, FIG. 4 shows a state in which the door 31 is in an opened state, and FIG. 6 shows a state in which the door 31 is opened and the cartridge tray 35 is drawn out from the apparatus main body 100*a*. FIG. 7 and FIG. 8 are perspective views showing the assembly structure of the main frame (main body frame) 80R, 80L and the cartridge tray 35 in the image forming apparatus 100 in their different operating states, respectively. Here, note that FIG. 7 shows a state in which the cartridge tray 35 is received in the interior of the apparatus main body 100*a*. Also, FIG. 8 shows a state in which the cartridge tray 35 is drawn out from the apparatus main body 100*a*.

In each cartridge P, the developer (toner) in the developing container in each developing means 3 is consumed each time an image is formed. In addition, when the developer in a cartridge has been consumed to such an extent that it is unable to form an image of a quality satisfactory to a user who bought the cartridge, the cartridge is replaced by a new cartridge.

Therefore, in general, the image forming apparatus 100 is provided with a developer amount detecting mechanism that serves to inform a user of the time for replacement of each cartridge P. A brief explanation will be given to one example thereof. A detection means (not shown) for detecting the amounts of developer in the individual cartridges P, respectively, is provided on the image forming apparatus 100. In addition, a control unit (not shown) in the image forming apparatus 100 makes a comparison between a threshold, which has been beforehand set for advance notice or warning of the end of the cartridge service life, and a remaining amount value of each developer detected by the detection unit. Then, when there is a cartridge P for which the value of the remaining amount of the developer therein has become less than the threshold, the control unit causes an indicator portion (not shown) provided in the apparatus main body 100*a* to indicate a previously-determined cartridge-service-life notice or warning. This facilitates the replacement of a cartridge P for which the remaining amount of the developer therein has become less than the predetermined amount, whereby the user is prompted to replace that cartridge P with a new one. As a result, the quality of output images is maintained.

In addition, in the image forming apparatus 100, a front access method, being excellent in usability, is adopted as the replacement method for the cartridges P. In the case of this front access method, the user draws out the cartridge tray 35 in front of the apparatus main body 100*a* with the cartridges P carried (supported) on the cartridge tray 35, which is constructed so as to be drawn out from the apparatus main body 100*a*. Then, the user takes out a cartridge P to be replaced from the cartridge tray 35 which is in a state having been drawn out from the apparatus main body 100*a*. Thereafter, the user puts (support) a new cartridge P on the cartridge tray 35. In this embodiment, the cartridges P are replaced in this manner.

Here, note that the cartridge tray 35 is constructed so as to move in a straight line when the user draws it out from the apparatus main body 100*a*, or pushes it into the apparatus main body 100*a*. In addition, the cartridge tray 35 is also constructed so as to move in parallel to a mounting surface (not shown) of the apparatus 100. However, the cartridge tray 35 is not limited to the case where it moves in parallel to the mounting surface, but may instead be constructed so as to move in an upward slanting direction or in a downward slanting direction.

That is, in front of the apparatus main body 100*a* (forward side), there is formed an opening portion 30 through which a cartridge P is inserted into the apparatus main body 100*a*, or taken out from the apparatus main body 100*a* (see FIG. 2). The opening portion 30 is opened and closed in accordance with the opening and closing operation of the door 31.

The door 31 according to this embodiment is constructed so as to be rotatable about a lateral shaft (hereinafter referred to as a hinge shaft 32) arranged at a lower side of the door 31 with respect to the apparatus main body 100*a*. That is, the user is able to close the opening portion 30 by causing the door 31 to rotate about the hinge shaft 32 in a rising direction (see FIGS. 1 and 2). Also, the user is also able to widely open the opening portion 30 by causing the door 31 to rotate about the hinge shaft 32 in a falling direction. Here, note that the door 31 is provided on its front side surface with a finger engaging portion 31*a* with which the user is able to open and close the door 31 by engaging his or her finger(s).

In addition, the image forming apparatus 100 has a pair of main frames (main body frames) 80L, 80R which serve as a frame structure of the apparatus main body 100*a*. In the following explanation, the pair of these frames are referred to as a left frame 80L and a right frame 80R, respectively (see FIGS. 7 and 8). A pair of tray support members (34L, 34R), which extend in a longitudinal direction that is a front and rear direction, are arranged on an inner side of the left frame 80L and an inner side of the right frame 80R, respectively. The pair of tray support members 34L, 34R are arranged in opposition to each other. A cartridge support member in the form of a cartridge tray 35 of a frame shape is arranged between the pair of tray support members 34L, 34R. The pair of tray support members 34L, 34R serve to support the tray 35 in such a manner that the tray 35 is able to slide in the front and rear (longitudinal) direction as well as in the horizontal direction. Thus, the tray support members 34R, 34L have a function to support the tray 35 in a sliding movable manner. In addition, the tray 35 has mounting portions for the four cartridges PY, PM, PC, PK, and is provided with a function to support the cartridges P.

Thus, the cartridges P are attached (supported) to the tray 35 in the order of the cartridges PK, PC, PM and PY from the front side to the rear side of the apparatus main body 100*a* (i.e., in a direction from a downstream side to an upstream side of the tray draw-out direction). That is, the cartridge PK of a high replacement frequency is arranged at the frontmost side. With such an arrangement, the replacement operability or convenience of the cartridge PK can be improved.

Then, the tray 35 can move between an inner side position I located at an inner side of the apparatus main body 100*a* (the main frame (or the main body frame) 80L, 80R and an outer side position O located at an outer side of the apparatus main body 100*a* by passing through the opening portion 30 with the individual cartridges P supported thereon. That is, the tray 35 can move between the inner side position I (the position indicated in FIG. 2) located inside of the opening portion 30 and the outer side position O (the position indicated in FIGS. 5 and 6) located outside of the opening portion 30. Here, note that the cartridge tray 35 is located at the outer side position O by being drawn out from the inner side position I by the user, and is located at the inner side position I by being pushed in from the outer side position O. The user attaches or detaches a cartridge P to the tray 35 located at the outer side position O. Accordingly, the outer side position O is a cartridge attaching and detaching position in which a user attaches and detaches a cartridge.

Here, note that the main body frame is not limited to the frame structure of the main body, but may include, for example, a cover with which a part or whole of the frame structure of the main body is covered. In case where such a cover is provided, an opening portion is formed in the cover, too.

Also, the apparatus main body 100*a* is a construction of the image forming apparatus 100 with the cartridges P and the tray 35 excluded therefrom.

When the user opens the door 31, the tray support members 34L, 34R are caused to move by a predetermined amount in a forward and upper direction in association with the rotational operation of the door 31. As a result, the tray support members 34L, 34R are drawn out to a position in which its front side portion protrudes by a predetermined amount from the opening portion 30 outwardly of the apparatus main body 100*a* (see FIGS. 3 and 4). Here, note that a mechanism for movement of the tray support members 34L, 34R will be described later in detail.

Here, the coupling of the drive output portion at the apparatus main body side to the drive input portion of each cartridge P is placed in a released state in accordance with the opening operation of the door 31 (i.e., driving is released). Also, the pressing force of each presser member 42, which serves to position and fix a corresponding cartridge P, is released (i.e., pressing is released). In addition, the electrical connection of the electrical power feeding portion at the apparatus main body side to the electrical contact of each cartridge P is also released (i.e., power feed is released). Moreover, the positioning and fixing of the tray 35 is released, too.

In such a state, it becomes possible to draw out the tray 35 from the apparatus main body 100*a*.

That is, the left frame 35*d* and the right frame 35*e* of the tray 35 are constructed so as to be fitted into longitudinally extending guide grooves 34*a*, which are formed on the inner sides of the right and left tray support members 34L, 34R, in a freely slidable manner (see FIG. 8). As a result, it is constructed such that the tray 35 is supported by the right and left tray support members 34L, 34R, and at the same time is slidable in the front and rear direction and in the horizontal direction.

Specifically, the tray 35 can be drawn out according to the following procedure. A knob 35*a* is provided at the front side of the tray 35. When the door 31 is opened, the knob 35*a* is placed into a state exposed from the opening portion 30. Then, when the user grasps the knob 35*a*, a draw-out prevention detent (not shown) provided on the tray 35 is disengaged from a main body side detent engagement portion (not shown). As a result, the tray 35 is placed into a state in which it is slidable with respect to the tray support members 34L, 34R. In this state, the user causes the tray 35 to slide in the forward direction and in the horizontal direction, so that the tray 35 is drawn out to a satisfactory extent up to a predetermined drawn-out position (the outer side position O) outside of the apparatus main body 100*a* (see FIG. 5 and FIG. 6). Here, note that the tray 35 can not be further drawn out from the above-mentioned drawn-out position under the action of a stopper (not shown) which is provided on the apparatus main body 100*a*. Here, note that the tray 35 may be constructed so as to be detached from the apparatus main body 100*a* by releasing the stopper (not shown). If constructed in this manner, the tray 35 can be detached from the apparatus main body 100*a* in a simple manner.

Thus, all the four cartridges PY, PM, PC, PK supported by the tray 35 pass through the opening portion 30 so that the upper surfaces of all these cartridges P are brought into a state exposed outside of the apparatus main body 100*a*. The tray 35, when drawn out by the predetermined amount, is inhibited from being drawn out any more by means of the stopper (not shown), as stated above. In addition, the tray 35, having been drawn out up to the predetermined drawn-out position, is stably kept in a horizontal state by means of the tray support members 34R, 34L. Here, note that in the state where the tray 35 is located at the outer side position O, the upper surfaces of all the cartridges P need not be necessarily exposed outside of the apparatus main body 100*a*. For example, the cartridge PY at the rearmost side may be located in the apparatus main body 100*a* (in the opening portion 30). Even in this case, it is easy for the user to perform replacement of the cartridge PY since the cartridge PY has been drawn out to the front side of the apparatus main body 100*a*. Also, the amount of drawing of the tray 35 can be made small, so there is an advantage that an area or space required for installation of the apparatus 100 can be decreased.

The tray 35 is constructed such that the four cartridges PY, PM, PC, PK can be attached to and detached from the tray 35 individually and separately from one another. Upon replacement of a used cartridge P, the user pulls out and removes the used cartridge P from the tray 35 by lifting it substantially right above (see an alternate long and two short dashes line in FIG. 6). Then, a new cartridge P is attached (supported) to the tray 35 by being inserted therein while being directed substantially right below. Thereafter, the user pushes the tray 35 into the interior of the apparatus main body 100*a*, and then closes the door 31. In this manner, the tray 35 can be moved to its attachment position (the image forming operation position X).

Here, note that a cartridge P may be one having a drum cover (not shown) of the opening and closing type for protecting the surface of its photosensitive drum 1. When the cartridge P is attached to the tray 35, this drum cover enters an opened state so as to expose the surface of the drum 1. On the other hand, when the cartridge P is detached from the tray 35, the drum cover enters a closed state so as to protect the surface of the drum 1. In addition, the drum cover can be of a manual type or an automatic type. In the former case, after pulling out a used cartridge P from the tray 35, the user closes the drum cover by hand. Then, after a drum cover of a new cartridge P is opened, the new cartridge P is attached (supported) to the tray 35. In the latter case, when a used cartridge P is removed from the tray 35 by being lifted therefrom, the drum cover is automatically closed in the course of the cartridge removing process. Then, when a new cartridge P is attached to the tray 35, the drum cover is automatically opened in the course of the cartridge attaching process.

Here, the cartridge tray 35, acting as the cartridge support member, is constructed in such a manner that it is movable in a direction crossing the axial direction of the photosensitive drum 1 provided in each cartridge. In addition, in accordance with the movement of this cartridge tray 35, the cartridges P can be selectively guided to the process cartridge detaching operation position outside of the apparatus main body (the outer side position O) or the image forming operation position X inside of the apparatus main body. Here, note that the process cartridge detaching operation position is a position in which the user performs an operation of supporting (attaching) a cartridge P onto the tray 35, and an operation of taking out a cartridge P supported on the tray 35 therefrom. In this embodiment, the user can attach a cartridge P to or detach a cartridge P from the tray 35 after drawing out the tray 35 up to the outer side position O. Therefore, working efficiency in attaching and detaching the cartridges P can be improved.

In addition, the tray support members 34R, 34L have a mechanism for moving the tray 35 from the attachment position (the image forming operation position X) in an upward direction or moving it in a downward direction toward the above-mentioned attachment position. The photosensitive drum 1 is moved away from the endless belt (member to be transferred) 13 by moving the tray 35 in the upward direction from the above-mentioned attachment position. Also, the photosensitive drum 1 is placed into contact with the endless belt 13 by moving the tray 35 in the downward direction toward the above-mentioned attachment position. Stated in another way, these tray support members 34L, 34R are provided with a function to support the tray 35 in a movable state. In addition, the tray support members 34R, 34L function to selectively guide the tray 35 to the above-mentioned attachment position or a position in which the tray 35 can be drawn out. Further, the tray support members 34R, 34L are interlocked with the opening and closing operation of the door 31, as stated above.

<Interlocking Mechanism between the Door and the Tray Support Members>

Figure 9:
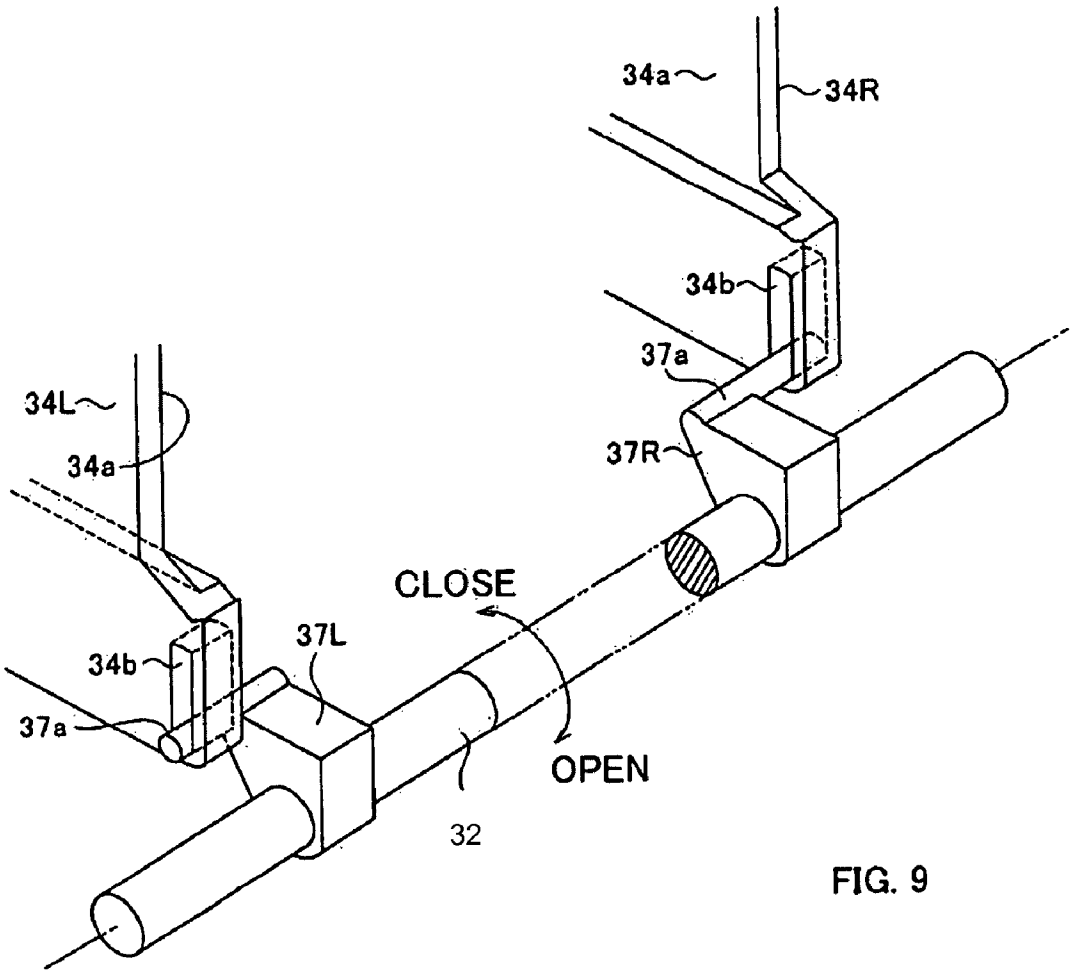
FIG. 9 is a perspective view showing major portions of an interlocking mechanism between a door and tray support members according to the embodiment of the present invention.
Figure 10A:
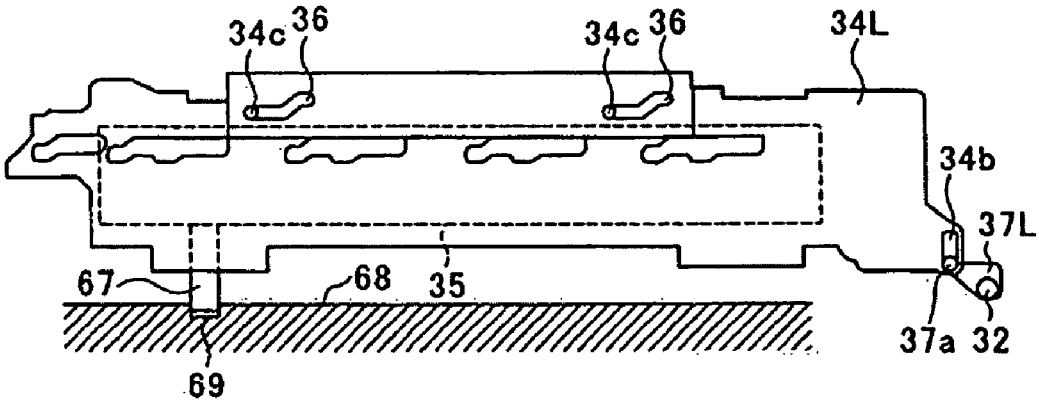
FIGS. 10A through 10C are explanatory views showing a mechanism for movement of the tray support members.
Figure 10B:
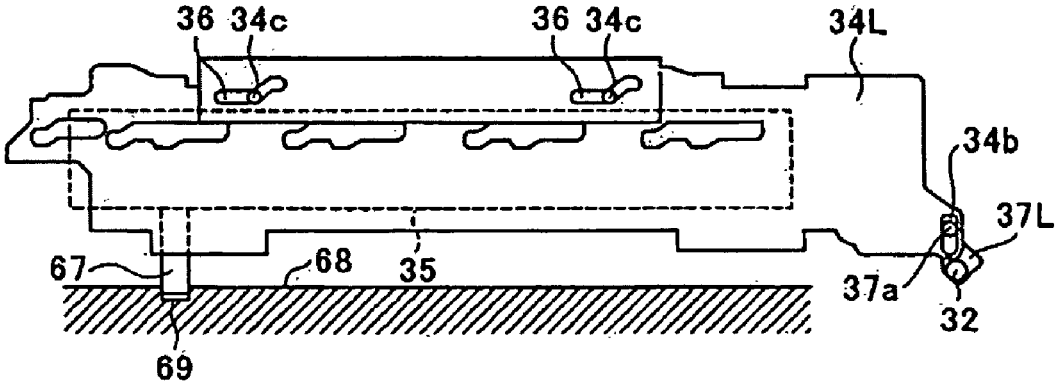
Figure 10C:
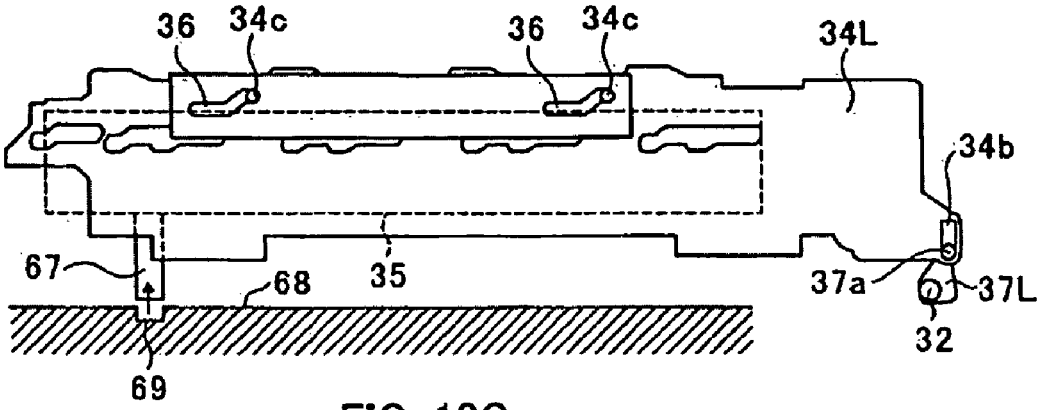
Figure 11:
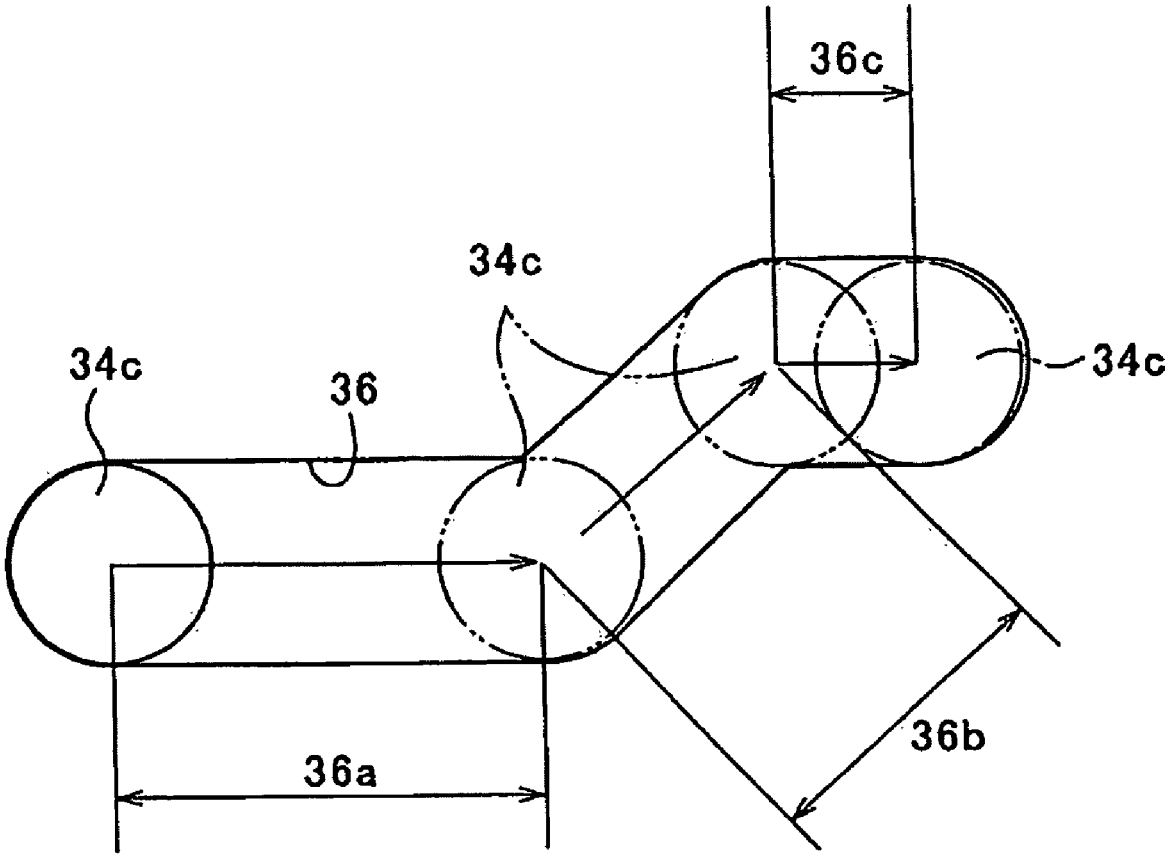
FIG. 11 is an enlarged view of a part in FIGS. 10A through 10C.
Figure 12:
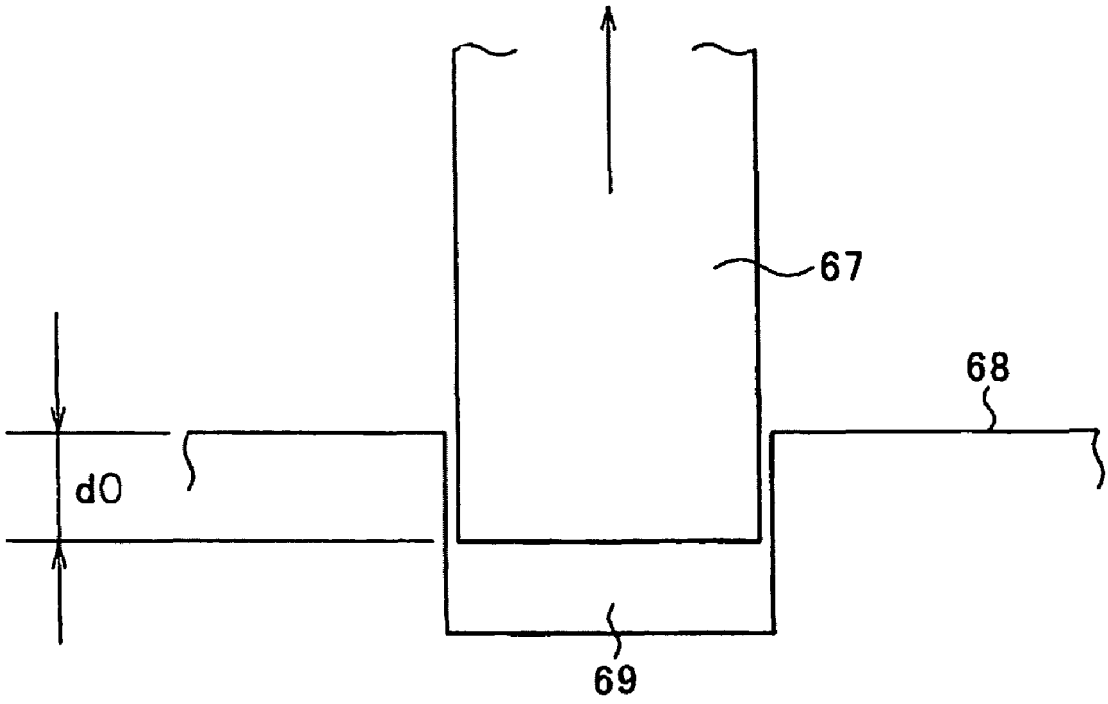
FIG. 12 is an enlarged view of a part in FIGS. 10A through 10C.
Figure 13:
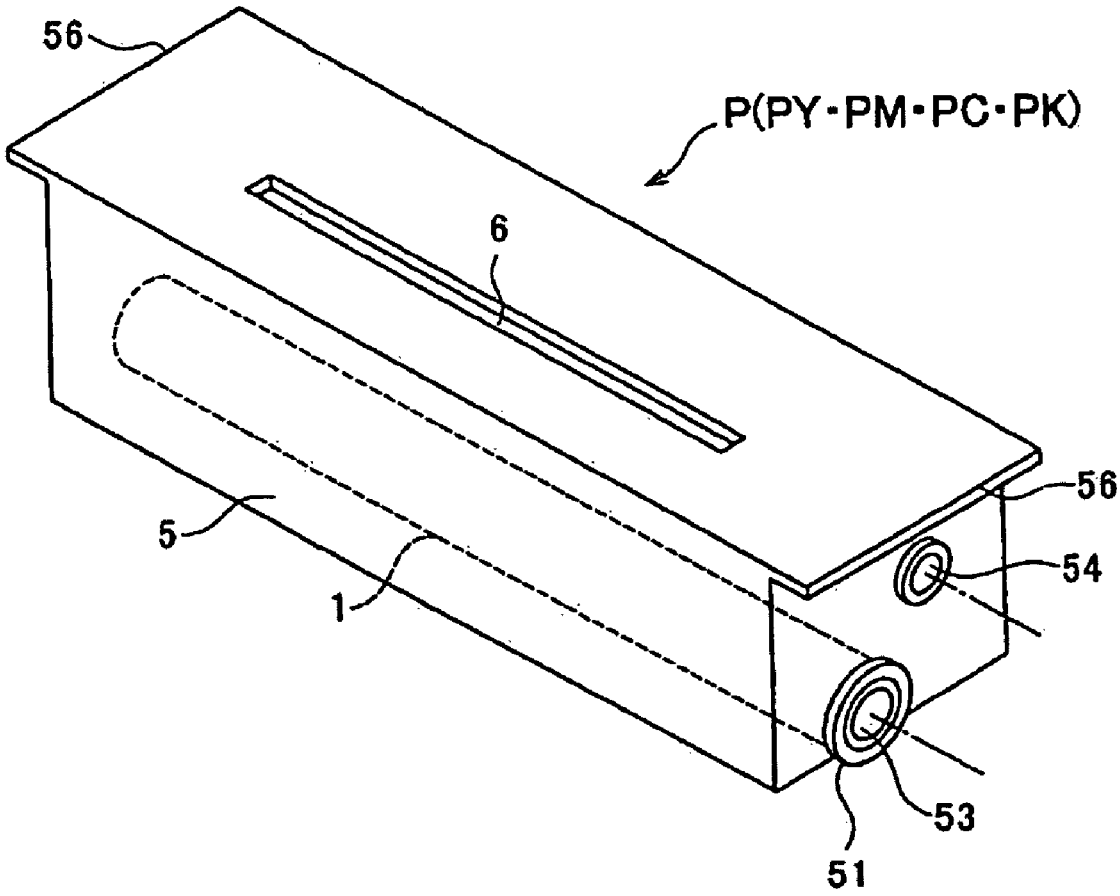
FIG. 13 is an external perspective view of a process cartridge according to the embodiment of the present invention.
Figure 14:
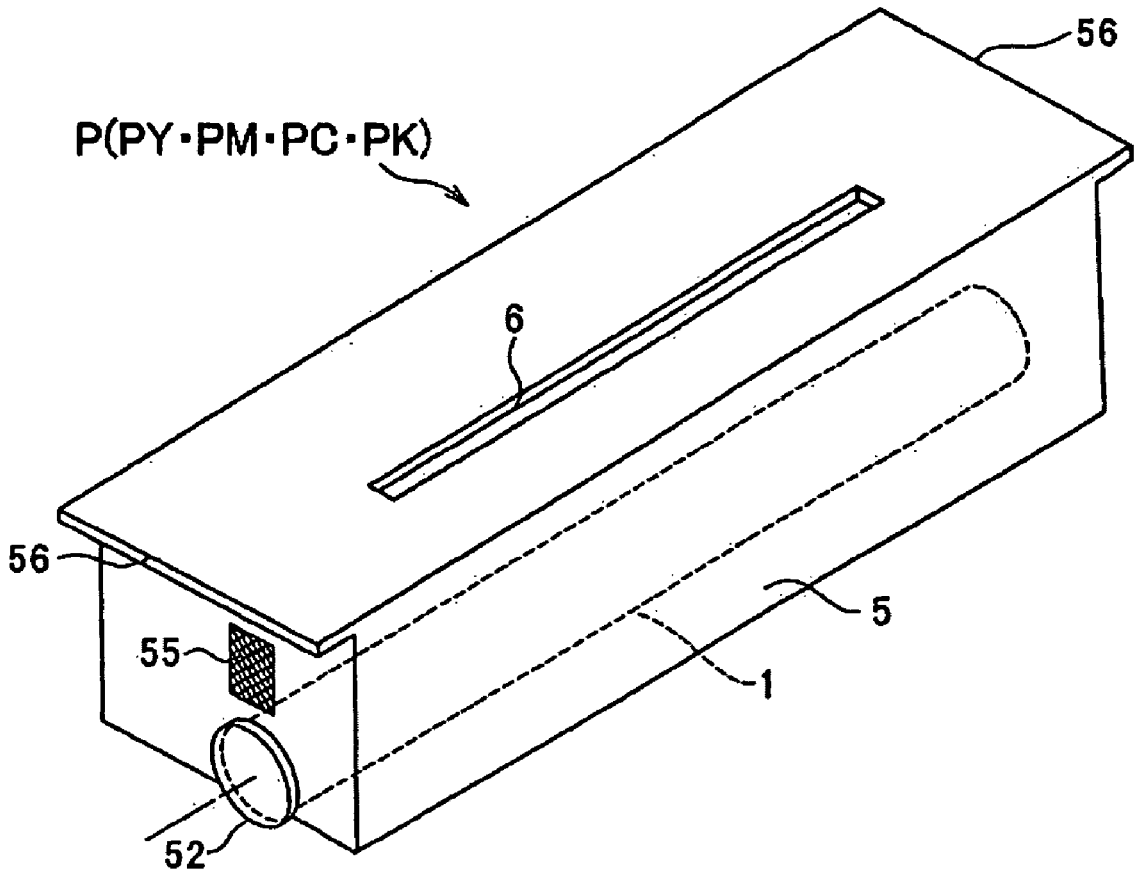
FIG. 14 is another external perspective view of the process cartridge according to the embodiment of the present invention.

Now, detailed reference will be made to an interlocking mechanism between the door 31 and the tray support members 34L, 34R according to one embodiment of the present invention while referring to FIG. 9 through FIG. 14. FIG. 9 is a perspective view illustrating major portions of the interlocking mechanism between the door 31 and the tray support members 34R, 34L. FIGS. 10A through 10C are explanatory views illustrating a mechanism for movement of the tray support members 34R, 34L. FIGS. 11 and 12 are enlarged views of different parts, respectively, of FIGS. 10A through 10C. FIGS. 13 and 14 are external perspective views of a cartridge P according to one embodiment of the present invention. Here, note that FIG. 13 is a perspective view seen from a driving side, and FIG. 14 is a perspective view seen from a non-driving side.

The hinge shaft 32 of the door 31 is horizontally arranged in the right and left direction with respect to the apparatus main body 100*a*. The hinge shaft 32 has its right and left opposite ends rotatably supported by the left frame 80L and the right frame 80R, respectively, which together constitute the main frame (the main body frame) of the apparatus main body 100*a*. The door 31 is integrally coupled with this hinge shaft 32. Accordingly, the hinge shaft 32 is caused to rotate in accordance with the opening and closing operation of the door 31.

The coupling arms 37L, 37R are arranged in the vicinity of the right and left opposite ends, respectively, of the hinge shaft 32. In addition, the coupling arms 37L, 37R have transverse shafts 37*a*, respectively. Here, note that the coupling arms 37L, 37R are integrally coupled with the hinge shaft 32 in such a manner that the transverse shaft 37*a* of the coupling arm 37L and the transverse shaft 37*a* of the coupling arm 37R are arranged in axial alignment with each other.

The transverse shaft 37*a* of the left coupling arm 37L is inserted into a vertically elongated hole 34*b* formed in a front side lower portion of the left tray support member 34L. Also, the transverse shaft 37*a* of the right coupling arm 37R is inserted into a vertically elongated hole 34*b* formed in a front side lower portion of the right tray support member 34R. The hinge shaft 32 is coupled with the tray support members 34L, 34R by means of such constructions. As the door 31 is opened and closed by the user, the coupling arms 37L, 37R are caused to rotate together with the hinge shaft 32. Therefore, the vertically elongated holes 34*b* have their inner peripheral wall surfaces pushed by the transverse shafts 37*a* formed on the coupling arms 37L, 37R, respectively, so that a front and rear (or longitudinal) force acts on each of the left and right tray support members 34L, 34R.

The left and right tray support members 34L, 34R are each provided with two pin shafts 34*c* that are arranged at a longitudinal interval therebetween (see FIGS. 10A through 10C). These pin shafts 34*c* are inserted into guide holes 36 formed in the left frame 80L and the right frame 80R, respectively. Thus, the pin shafts 34*c* are inserted into the guide holes 36, whereby the tray support members 34L, 34R are supported to the left frame 80L and the right frame 80R, respectively.

Here, note that in FIG. 10A through 10C, there are illustrated the two pin shafts 34*c* on the left tray support member 34L and the guide holes 36 formed in the left frame 80L. The pin shafts and guide holes on the right side are not particularly illustrated, but are similar in construction to the left ones, and the two pin shafts 34*c* on the right tray support member 34R and the guide holes 36 formed in the right frame 80R are constructed so as to be symmetric with those on the left side. Accordingly, the left and right tray support members 34L, 34R can move with respect to the left frame 80L and the right frame 80R, respectively, so that the pin shafts 34*c* can move along the corresponding guide holes 36.

FIG. 11 is a view in which a guide hole 36 is illustrated on an enlarged scale. Here, note that the two guide holes 36 formed in the left frame 80L are of the same shape, and the two guide holes 36 formed in the right frame 80R are of the same shape, too. The guide holes 36 formed in the right frame 80R and the guide holes 36 formed in the left frame 80L are symmetric in shape with each other.

Each of the guide holes 36 has a first guide region 36*a*, a second guide region 36*b* that is connected to the first guide region 36*a*, and a third guide region 36*c* that is connected to the second guide region 36*b*. The first guide region 36*a* is formed to be horizontal in the front and rear direction. The second guide region 36*b* is formed to be connected to the first guide region 36*a* in a pin shaft advancing direction, and to extend in an upwardly inclined manner. The third guide region 36*c* is formed to be connected to a top portion of the second guide region 36*b*, and to hold the corresponding pin shaft 34*c* at the top position of the second guide region 36*b*.

A front and rear force acts on the tray support members 34L, 34R in accordance with the opening and closing operation of the door 31, as stated above. As a result, the tray support members 34L, 34R are caused to move with respect to the left frame 80L and the right frame 80R, respectively, so as to move the pin shafts 34*c* along the corresponding guide holes 36, respectively. Specifically, when the door 31 is opened, the tray support members 34L, 34R are driven to first move by the length of the first guide region 36*a* in a forward and horizontal direction, and then to move in an upwardly slanting and forward direction under the guidance of the second guide region 36*b*. Thereafter, the tray support members 34L, 34R are caused to slightly move by the length of the third guide region 36*c* in the forward and horizontal direction.

FIG. 10A illustrates the positional relation between the left tray support member 34L and the guide holes 36 therein in a state where the door 31 is completely closed with respect to the apparatus main body 100*a*. In the state where the door 31 is completely closed, the tray support members 34L, 34R are located at the rear side in the apparatus main body 100*a*. At this time, the pin shafts 34*c* are each located at the rear end of the first guide region 36*a* of the corresponding guide hole 36. Accordingly, the tray support members 34L, 34R are located at lower positions, and the tray 35 supported by these tray support members 34L, 34R is held at a lower predetermined position.

At this time, upper surface portions of each cartridge P supported on the tray 35 at the right and left sides of the longitudinal direction thereof are pressed by the corresponding presser members 42, respectively. As a result, a lower surface portion of a drive side bearing portion 51 and a lower surface portion of a non-drive side bearing portion 52 in each cartridge P are placed in a state where they are pressed against positioning portions (not shown) formed on stay members (inner side plates), respectively, which are mounted on the apparatus main body 100*a*. As a result, each cartridge P is fixed with respect to the apparatus main body 100*a* in the state positioned at a prescribed position. Here, note that the position of each cartridge P at this time corresponds to the image forming operation position X, i.e., the position in which an image forming operation is carried out by the use of the cartridge P.

In addition, in this state, a lower surface of the photosensitive drum 1 of each cartridge P is in a state where it is in stable contact with an upper surface of the endless belt 13. Also, a drum drive coupling (not shown) and a developer drive coupling (not shown) on the apparatus main body side are in fitting engagement with the coupling engagement portions 53, 54, respectively, in each cartridge P. Further, the individual cartridges P have individual electrical contacts 55 which are placed in a state electrically connected to electrical contacts 75*a* through 75*d*, respectively, on the apparatus main body side through individual intermediate electrical contacts 72*a* through 72*d*, respectively, formed on the tray 35. As a result, electricity is supplied from the apparatus main body 100*a* to the individual cartridges P.

The tray 35 is formed on its left side with a protrusion 67 that protrudes downwardly. In the state where the door 31 is completely closed with respect to the apparatus main body 100*a*, the protrusion 67 has its lower end fitted into a hole 69 formed in an intermediate transfer belt holding member 68 fixedly secured to the apparatus main body 100*a*. In addition, the tray 35 has a hole formed therein on its right side, and a pin formed on the right frame 80R is fitted into the hole in the tray 35. With the above construction, the tray 35 is positioned with respect to the apparatus main body 100*a*.

FIG. 10B illustrates the positional relation between the left tray support member 34L and the guide holes 36 therein in a state where the door 31 is opened halfway.

The tray support members 34 are caused to move toward the forward side in the apparatus main body 100*a* in association with an opening operation of the door 31. Specifically, the tray support members 34 are first moved in the forward and horizontal direction by the length of the first guide region 36*a* of each guide hole 36, with the pin shafts 34*c* being guided by the first guide regions 36*a* of the guide holes 36. FIG. 10B illustrates the state of this movement.

The drum drive coupling and the developer drive coupling corresponding to each cartridge P are disengaged in association with the opening operation of the door 31. In addition, pressing on the individual cartridges P due to the presser members 42 is also released. Here, note that in this process, the protrusion 67 formed on the left side of the tray 35 is kept fitted into the hole 69 formed in the intermediate transfer belt holding member 68. Accordingly, the tray 35 does not follow the movement of the tray support members 34L, 34R.

The tray support members 34 are caused to move further toward the forward side in the apparatus main body 100*a* in association with the continued opening operation of the door 31. As a result, the tray support members 34L, 34R are moved in an upwardly slanting direction, with the pin shafts 34*c* being guided by the second guide regions 36*b* of the guide holes 36. Here, note that in this movement process, the electrical connections between the electrical contacts 55 of the individual cartridges and the apparatus main body side are released.

Here, as shown in FIG. 12, let us assume that an amount of insertion of each protrusion 67 with respect to a corresponding hole 69 in the state where the door 31 is completely closed is d0, and that an amount of rise of each protrusion 67 according to an upper movement of the tray support members 34L, 34R is d1. When the tray support members 34L, 34R are caused to move in an upwardly slanting direction, the tray 35 follows only the vertical movement of the tray support members 34L, 34R during the time when the protrusions 67 are fitted in the holes 69 (i.e., d0>d1). Further, when the tray support members 34L, 34R are raised by d0 or more, the protrusions 67 come out from the holes 69. As a result, the tray 35 is put into a state where it is movable in the horizontal direction.

By adopting such a construction, the tray 35 is prevented from moving in the horizontal direction in a state where the lower surface of the photosensitive drum 1 of each cartridge P is in contact with the endless belt 13. Accordingly, it is possible to prevent flaws from being generated due to rubbing between the photosensitive drums 1 and the endless belt 13. Here, note that as for the relation between the holes formed in the right side of the tray 35 and the pins formed on the right frame 80R, there can be adopted a construction similar to that at the left side thereof, as stated above.

FIG. 10C illustrates the positional relation between the left tray support member 34L and the guide holes 36 therein in a state where the door 31 is opened completely.

In this state, the pin shafts 34*c* reach the horizontal third guide regions 36*c* of the guide holes 36, respectively. That is, the tray support members 34L, 34R are slightly moved in the horizontal direction after having been moved in the upwardly slanting direction. In this case, the pin shafts 34*c* are located in the horizontal third guide regions 36*c*, and hence, the tray support members 34L, 34R are supported at a constant vertical position in a stable manner. As a result, there will be no interference to the work of drawing out of the tray 35, the operation of replacing the cartridges P or the like.

In the state where the door 31 is completely opened, the protrusions 67 come off the holes 69 completely, as shown in FIG. 10C. Accordingly, the tray 35 can be freely slid with respect to the tray support members 34L, 34R in the front and rear direction as well as in the horizontal direction.

As can be seen from above, the protrusions 67 and the holes 69 cooperate to exert the function of restricting the movement of the tray 35 so as not to generate friction between the photosensitive drums 1 and the endless belt 13. In addition, such a restriction on the movement of the tray 35 is removed after the photosensitive drums 1 and the endless belt 13 are separated from each other.

As described above, the tray support members 34L, 34R are caused to move in the front and rear direction of the apparatus main body 100*a* in association with an opening and closing operation of the door 31. In the process of such an operation, however, the tray 35 is caused to move only in the vertical direction. As a result, the operation of putting the tray 35 into and out of the apparatus main body 100*a* can be carried out without generating friction between the photosensitive drums 1 of the cartridges P supported on the tray 35 and the endless belt 13.

<Cartridge>

Reference will be made to a cartridge P while referring to FIG. 13 and FIG. 14.

A cartridge P is a box-shaped assembled unit (assembly) whose right and left directions are the axial direction of the photosensitive drum 1 received therein, this right and left direction being a longitudinal direction. The photosensitive drum 1 is rotatably supported by a pair of right and left bearing portions 51, 52 which are formed on a right side surface portion and a left side surface portion, respectively, of the cartridge frame 5. The right bearing portion 51 is provided with the coupling engagement portion 53, which acts as a drum drive input portion for driving the photosensitive drum 1 to rotate. Also, the coupling engagement portion 54, acting as a developer drive input portion for rotating the developing roller 3*a*, is provided on the right side surface portion of the cartridge frame 5. Further, the cartridge electrical contact 55 is formed on the left side surface portion. In addition, the cartridge frame 5 has a crown plate portion which protrudes to the right and left to form a pair of eaves 56 on the left side surface portion and the right side surface portion, respectively. In the cartridge P as constructed above, the right side surface portion provided with the coupling engagement portions 53, 54 is a drive side, and the left side surface portion on the opposite side thereof is a non-drive side. Here, note that the coupling engagement portion 53 receives a driving force for rotating the photosensitive drum 1 from the apparatus main body 100*a*, and the coupling engagement portion 54 receives a driving force for rotating the developing roller 3*a* from the apparatus main body 100*a*.

<External Construction of the Cartridge Tray>

Figure 15:
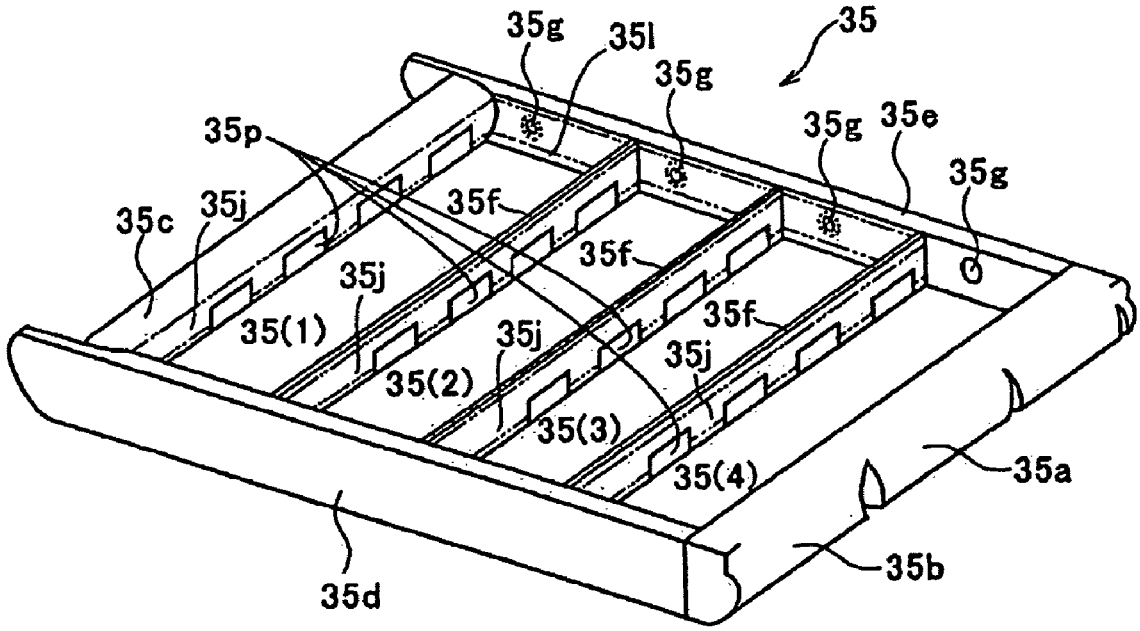
FIG. 15 is an external perspective view of a cartridge tray (cartridge support member) according to the embodiment of the present invention.

Reference will be made to the external construction of the cartridge tray (cartridge support member) 35 while referring to FIG. 15. FIG. 15 is an external perspective view of the tray 35. The tray 35 has a large frame portion of a rectangular shape. The rectangular-shaped large frame portion is composed of a front frame 35*b*, a rear frame 35*c*, a left frame 35*d*, and a right frame 35*e*. In this large frame, there are arranged three partition plates 35*f* which act as partition portions for partitioning adjacent cartridges P from each other. The region in the large frame is partitioned into four substantially equal parts in the front and rear (i.e., longitudinal) direction thereof by means of these three partition plates 35*f*. By doing so, a first oblong small frame portion 35(1), a second oblong small frame portion 35(2), a third oblong small frame portion 35(3), and a fourth oblong small frame portion 35(4) are sequentially constructed from the rear frame 35*c* side toward the front frame 35*b* side. These first through fourth oblong small frame portions 35(1) through 35(4) are those portions (attachment portions) which support the cartridges PY, PM, PC, PK, respectively. In addition, in the right frame 35*e* in the individual oblong small frame portions 35(1) through 35(4), there are formed holes 35*g*, respectively, into or out of which the corresponding developer drive couplings (not shown) are moved. Here, note that the drum drive couplings (not shown) are moved toward and away from the coupling engagement portions 53, respectively, at a lower side than the right frame 35*e*. Both of the above-mentioned couplings are mounted on the apparatus main body 100*a*.

The individual cartridges P are inserted from above into the first through fourth oblong small frame portions 35(1) through 35(4) in the tray 35 by the user. At this time, the lower surfaces of the eaves 56 of each cartridge P are placed into abutment with the left frame 35*d* and the right frame 35*e*, respectively. As a result, each cartridge P is supported on the tray 35. Here, note that each cartridge P is supported on the tray 35 by the abutment of its eaves 56 against the left frame 35*d* and the right frame 35*e*, and hence is supported by the tray 35 in a rough manner. Accordingly, in a state where the tray 35 has been drawn out from the apparatus main body 100*a*, the user is able to attach and detach the cartridges P to and from the tray 35 in an easy manner.

<Ventilation Channels>

Next, reference will be made to ventilation channels in the image forming apparatus 100 and the tray 35 according to the first embodiment of the present invention while referring to FIG. 15 through FIG. 20.

Figure 16:
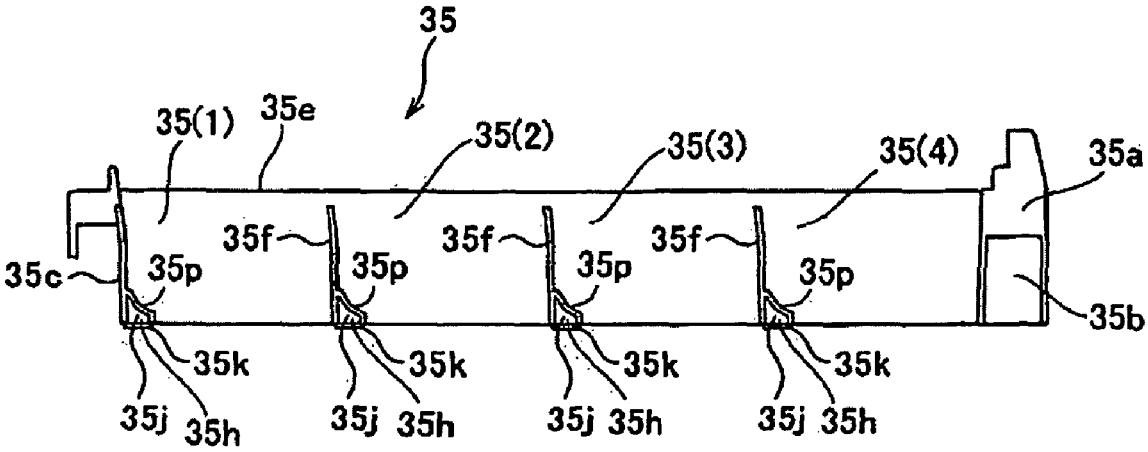
FIG. 16 is a schematic cross sectional view in which a cartridge tray (cartridge support member) according to a first embodiment of the present invention is cut in a front and rear direction.
Figure 17:
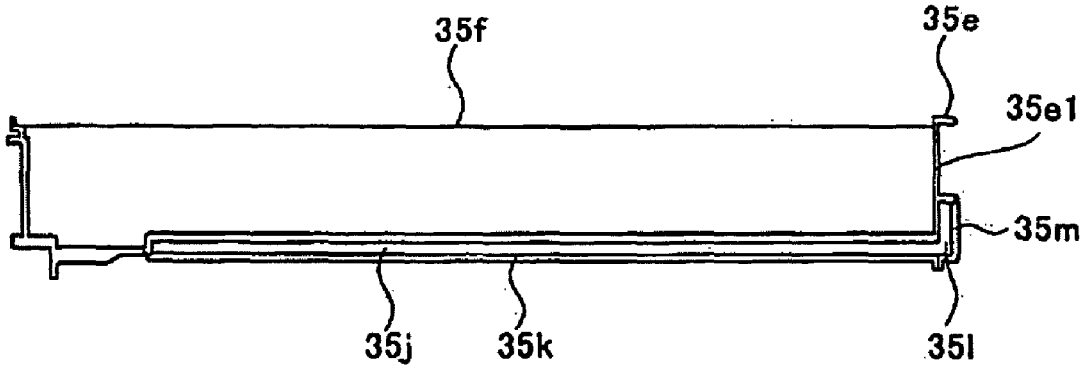
FIG. 17 is a schematic cross sectional view in which the cartridge tray (cartridge support member) according to the first embodiment of the present invention is cut in a right and left direction.
Figure 18:
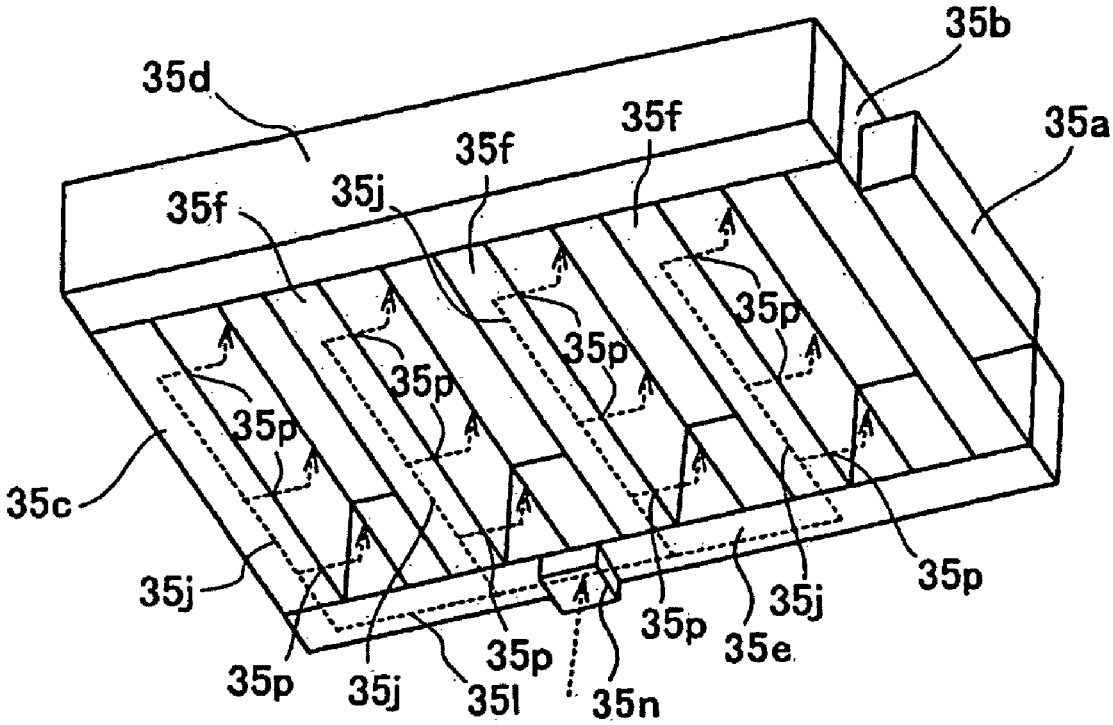
FIG. 18 is a schematic cross sectional view in which the cartridge tray (cartridge support member) according to the first embodiment of the present invention is seen from below.
Figure 19:
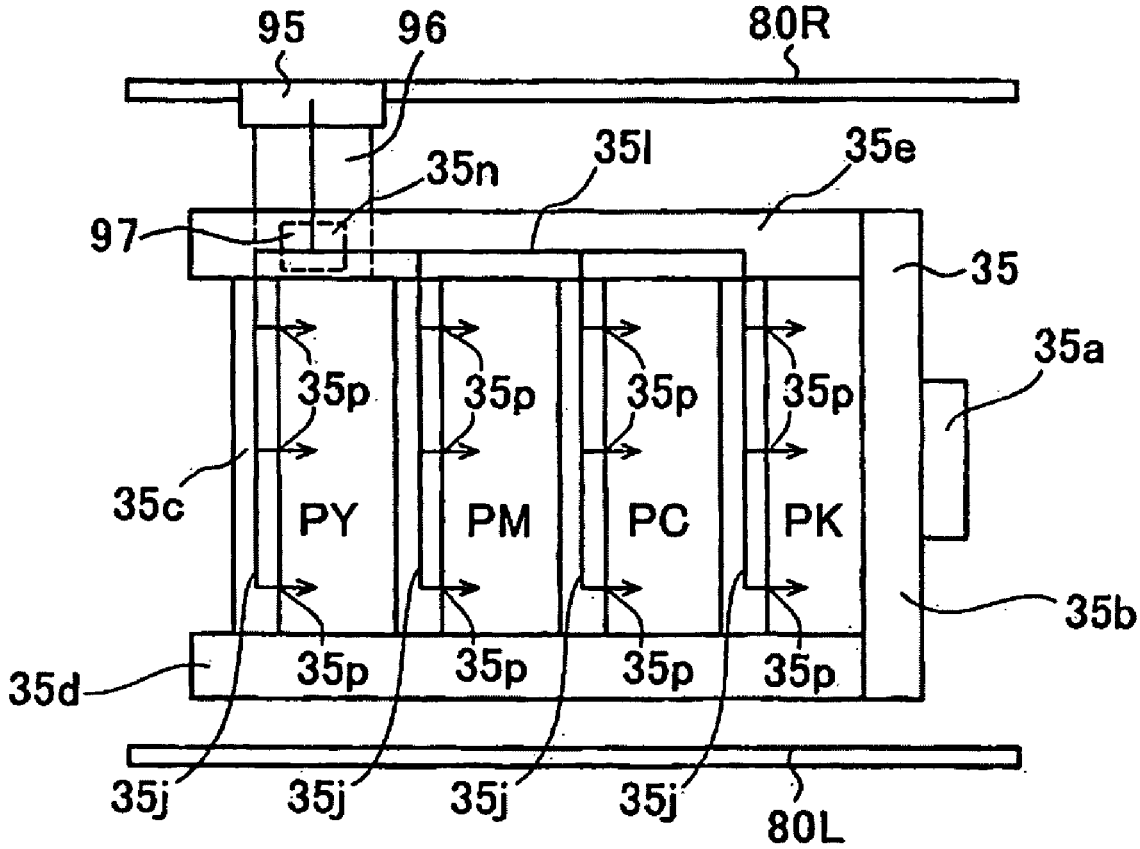
FIG. 19 is a view in which the arrangement relation between the cartridge tray (cartridge support member) and a main body frame according to the first embodiment of the present invention is seen from above.
Figure 20:
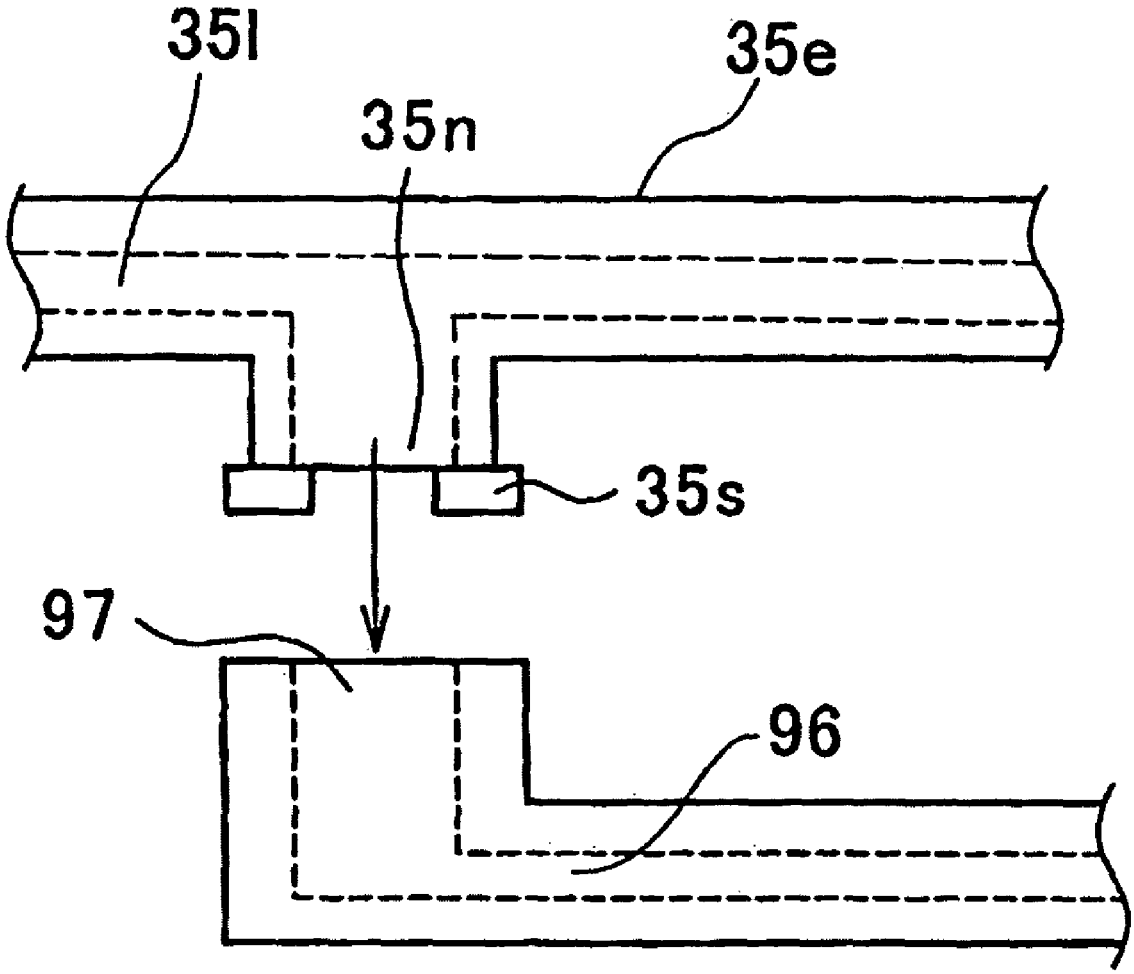
FIG. 20 is a schematic view showing how a ventilation channel at a cartridge tray (cartridge support member) side and a ventilation channel at an apparatus main body side according to the first embodiment of the present invention are connected with each other.

FIG. 16 is a schematic cross sectional view in which the tray 35 according to the first embodiment of the present invention is cut in the front and rear direction. FIG. 17 is a schematic cross sectional view in which the tray 35 is cut in the right and left direction. FIG. 18 is a schematic perspective view in which the tray 35 is seen from below. FIG. 19 is a view in which the arrangement relation between the tray 35 and the main body frame 80 is seen from above. FIG. 20 is a schematic view illustrating a state where a ventilation channel on the tray side and a ventilation channel (i.e., a second ventilation channel) on the apparatus main body side are connected with each other. Here, note that in FIG. 16 and FIG. 18, the holes 35*g* (FIG. 15) formed in the right frame 35*e* are omitted.

The rear frame 35*c* and the partition plates 35*f* forming part of the tray 35 each have a hollow portion 35*j* therein that forms part of a ventilation channel (i.e., a first ventilation channel). A main portion of the rear frame 35*c* and a main portion of each partition plate 35*f* are each of a shape having a groove 35*h* formed on a bottom surface so as to extend in the right and left direction. Each hollow portion 35*j* is formed by covering the groove 35*h* with a cover 35*k* (see FIG. 16).

Also, the right frame 35*e* of the tray 35 has a hollow portion 35*l* therein that forms part of the ventilation channel (i.e., the first ventilation channel). Here, note that this hollow portion 35*l* is formed of an outer wall portion 35*e*1 of a main portion of the right frame 35*e*, and a cover 35*m* of L-shaped cross section that is attached to the outer wall portion 35*e*1 (see FIG. 17).

The hollow portions 35*j* formed in the individual partition plates 35*f* and the rear frame 35*c*, respectively, are each connected with the hollow portion 35*l* formed in the right frame 35*e*.

In addition, the right frame 35*e* is provided on its bottom surface side with an inlet 35*n* (FIG. 18 and FIG. 20) for introducing outside air into the hollow portion 35l. Further, the partition plates 35*f* and the rear frame 35*c* each have a plurality of outlets 35*p* formed therethrough at locations opposing the cartridges P attached to the tray 35 for discharging the outside air that flows in the hollow portions 35*j* (see FIG. 15, FIG. 16 and FIG. 18).

With the above-mentioned construction, the outside air introduced into the inlet 35*n* passes through the hollow portion 35*l* formed in the right frame 35*e*, so that it is distributed to the hollow portions 35*j* formed in the rear frame 35*c* and the partition plates 35*f*, respectively. Then, the outside air flowing in the individual hollow portions 35*j* is discharged from the plurality of outlets 35*p* formed in the rear frame 35*c* and the partition plates 35*f*, respectively, to the cartridges P. That is, the outlets 35*p* discharge the outside air introduced into the hollow portion 35*l* (first ventilation channel) and the hollow portions 35*j* (first ventilation channel) so as to impinge against the cartridges P. The outlets 35*p* are arranged at a plurality of locations (e.g., four in this embodiment) along the longitudinal direction of each cartridge P (i.e., the longitudinal direction of each photosensitive drum 1) supported on the tray 35. Accordingly, each cartridge P can be efficiently cooled.

A sealing member 35*s* composed of a low elasticity body (e.g., sponge) is adhered to an opening (opening edge) of the inlet 35*n* (FIG. 20).

The right frame 80R is provided with an air vent 96 which serves as a ventilation channel (second ventilation channel) for taking in air from outside of the apparatus main body 100*a* into the interior of the apparatus main body 100*a* (see FIG. 19). A fan 95 is arranged in the air vent 96 for sending the outside air to the interior of the apparatus main body 100*a*. In addition, the air vent 96 has an opening portion 97 arranged at the inner side of the apparatus main body 100*a* (FIG. 20).

Here, it is constructed such that in a state where the door 31 has been completely closed with respect to the apparatus main body 100*a*, the inlet 35*n* arranged at the tray 35 side is disposed at a location opposing the opening portion 97 arranged at the apparatus main body 100*a* side. In this state, the sealing member 35*s* adhered to the opening (i.e., opening edge) of the inlet 35*n* is in contact with and is disposed along an opening edge of the opening portion 97. With such an arrangement and construction, it is possible to prevent leakage of air from a part where a ventilation channel (the second ventilation channel and the air vent 96) on the apparatus main body 100*a* side and a ventilation channel (the first ventilation channel and the hollow portions 35*j*, 35*l*) on the tray 35 side are connected with each other.

Here, note that the tray support members 34L, 34R are caused to move in the front and rear direction of the apparatus main body 100*a* in association with the opening and closing operation of the door 31, as stated above. However, in the course of such a process, the tray 35 is moved only in the vertical direction. Accordingly, in this process, the inlet 35*n* on the tray 35 side and the opening portion 97 on the apparatus main body side are caused to move in a direction toward and away from each other while keeping their positions in opposition to each other. An arrow in FIG. 20 indicates the direction of movement of the tray 35 at the time when the door 31 is closed. As illustrated, when the door 31 is closed, the inlet 35*n* on the tray 35 side is approaching directly toward the opening portion 97 on the apparatus main body side. When the cartridges P are located in the image forming operation position X, the inlet 35*n* and the opening portion 97 are brought into connection with each other. On the other hand, when the door 31 is opened, the inlet 35*n* on the tray 35 side is caused to move directly away from the opening portion 97 on the apparatus main body side.

With the above-mentioned construction, it is possible to suppress the generation of friction between the sealing member 35*s* adhered to the opening (the opening edge) of the inlet 35*n* and the apparatus main body 100*a*. As a result, wear of the sealing member 35*s* can be suppressed, and peeling off of the sealing member 35*s* can also be suppressed. Although in this embodiment, there has been illustrated the construction where the sealing member 35*s* is provided at the opening of the inlet 35*n* on the tray 35 side, a sealing member may be provided at the opening (i.e., opening edge) of the opening portion 97 on the apparatus main body side.

As described above, by closing the door 31, the air vent 96 (second ventilation channel) provided on the right frame 80R and the hollow portions 35*j*, 35*l* (first ventilation channel) provided in the tray 35 are brought in a state connected with each other. At this time, each cartridge P is located at the image forming operation position X, and outside air is blown into the air vent 96 (second ventilation channel) by the rotation of the fan 95. Then, the outside air blown into the air vent 96 passes through the hollow portions 35*j*, 35*l*, and is discharged from the plurality of outlets 35*p* formed in the rear frame 35*c* and the partition plates 35*f*, respectively, toward the cartridges P. As a result, the cartridges P are cooled by the thus sprayed outside air. The air discharged from the outlets 35*p* goes upward after having been sprayed onto the cartridges, and further reaches the scanner unit 11 that is arranged above the cartridges P. Thereafter, the air is discharged to the outside of the apparatus main body 100*a* from an exhaust hole (not shown) formed in the top cover that has the discharge tray 25 on the upper surface of the apparatus main body.

<Advantages of the Image Forming Apparatus and the Tray according to this Embodiment>

As described in the foregoing, in the image forming apparatus 100 according to this embodiment, a construction is adopted in which the ventilation channel (the hollow portions 35*j*, 35*l*) is provided in the interior of the tray 35, so that outside air is discharged (sprayed) toward the cartridges P supported on the tray 35. As a result, the outside air impinges directly on the cartridge P, whereby the cartridges P are cooled. Thus, in this embodiment, the ventilation channel for sending outside air for cooling the cartridges is arranged in the tray 35, which is a member required when a front access method excellent in usability is adopted.

Accordingly, there is no need to provide a special duct dedicated for sending outside air for cooling the cartridges, thereby preventing an increase in the number of required parts, and achieving a reduction in size and cost of the apparatus. In addition, since the outlets 35*p* for discharging the outside air toward the cartridges P are formed in the tray 35, it is possible to cool the cartridges in an effective manner.

Here, note that the tray 35 is located in the interior of the apparatus main body 100*a* at the time of image formation. However, in this embodiment, it is constructed such that the air vent 96 (second ventilation channel) provided on the right frame 80R of the apparatus main body 100*a* and the hollow portions 35*j*, 35*l* (first ventilation channel) provided in the tray 35 can be connected with each other. Accordingly, outside air is sent directly to the hollow portions 35*j*, 35*l* formed in the tray 35. As a result, it is possible to prevent the prior warming of air sent to the hollow portions 35*j*, 35*l* formed in the tray 35 because this air is outside air.

Embodiment 2

Now, a second embodiment of the present invention will be described while referring to FIG. 21. In above-mentioned first embodiment, a construction has been illustrated in which the plurality of outlets 35*p* are provided in the rear frame 35*c* and the partition plates 35*f* of the tray 35. In contrast to this, in this second embodiment, a construction is illustrated in which a plurality of outlets 35*p* are formed in a right frame 35*e* of a cartridge tray (cartridge support member) 35. The construction and operation of this second embodiment other than the construction for the ventilation channel of the tray 35 are the same as those of the above-mentioned first embodiment, so an explanation of the same or like component parts will be omitted. In addition, the same symbols will be attached to the same component parts.

Figure 21:
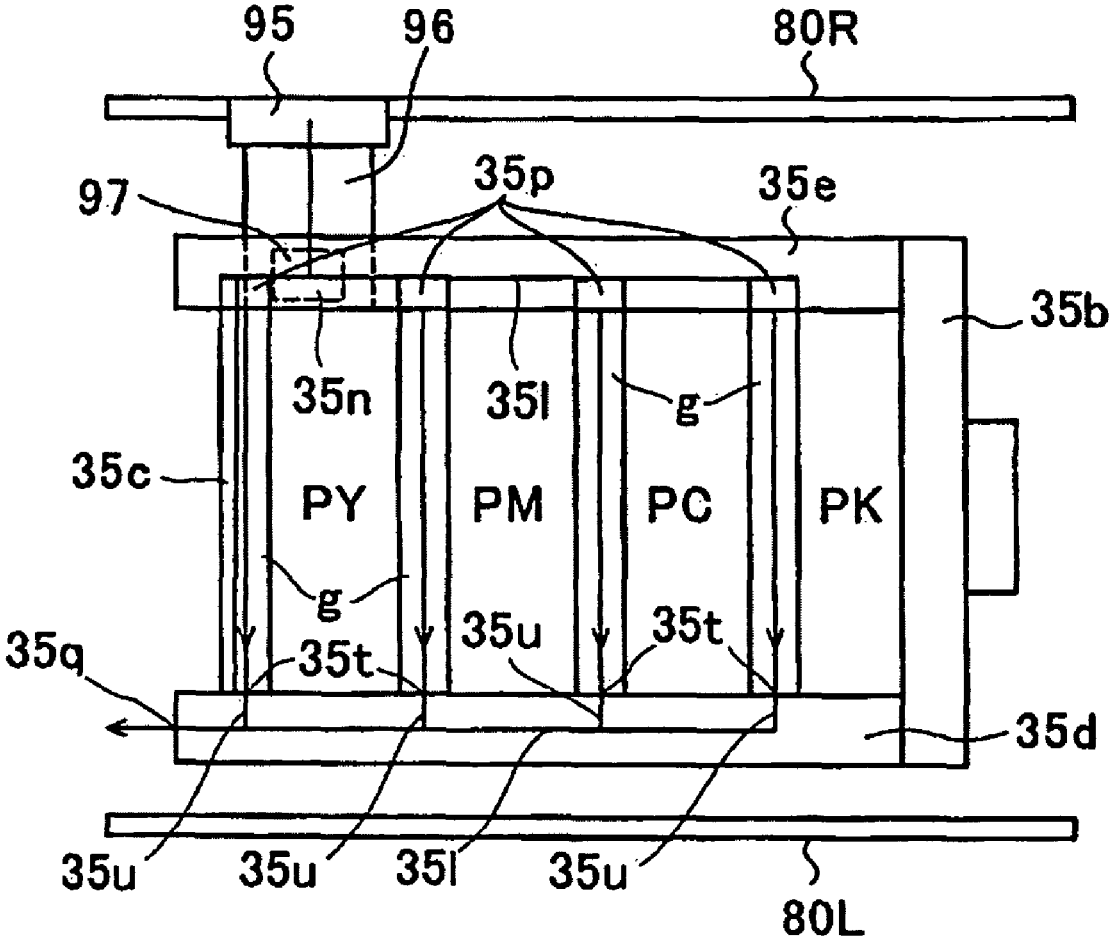
FIG. 21 is a view in which the arrangement relation between the cartridge tray (cartridge support member) and a main body frame according to a second embodiment of the present invention is seen from above.

FIG. 21 is a view in which the arrangement relation between the tray 35 and the main body frame 80R, 80L according to the second embodiment of the present invention is seen from above.

In this second embodiment, the tray 35 has a rectangular large frame which is composed of a front frame 35*b*, a rear frame 35*c*, a left frame 35*d*, and a right frame 35*e*. In addition, in this embodiment, the right frame 35*e* and the left frame 35*d*, among the frames constructing the tray 35, have hollow portions 35*l* formed therein, which constitute a ventilation channel. Further, in this embodiment, there are gaps g between individual cartridges P supported on the tray 35 as well as a gap g between the rear frame 35*c* and a cartridge PY. The right frame 35*e* has outlets 35*p* formed therein at four places to lead to the hollow portions 35*l* (first ventilation channel), so that the outlets 35*p* are each arranged to open at one end portion (i.e., a side where the right frame is arranged) in the longitudinal direction (i.e., in the longitudinal direction of each cartridge P, and in the longitudinal direction of each photosensitive drum 1) of each corresponding gap g. In addition, the left frame 35*d* has an opening portion 35*q* formed at a rear side thereof. Here, note that a construction in which, where a door 31 has been completely closed with respect to the apparatus main body 100*a*, an inlet 35*n* arranged on the right frame 35*e* is disposed at a location opposing an opening portion 97 arranged at an inner side of the apparatus main body 100*a*, is similar to that in the above-mentioned first embodiment. In addition, the construction of a ventilation channel on the apparatus main body side and the provision of a sealing member, which serves to prevent the leakage of air from a part where the ventilation channel on the apparatus main body side and the ventilation channel on the tray 35 side are connected with each other, are similar to those in the above-mentioned first embodiment.

According to the image forming apparatus of this second embodiment, outside air introduced through the ventilation channel (second ventilation channel) on the apparatus main body side is sent to the hollow portion 35*l* (first ventilation channel) in the right frame 35*e*, from which the outside air is discharged from the four outlets 35*p* formed in the right frame 35*e* to the gaps g between individual adjacent cartridges P and the gap g between the rear frame 35*c* and the cartridge PY. Specifically, the outside air is discharged from the outlets 35*p* so as to impinge on the cartridges P, whereby the cartridges P are cooled by the outside air. That is, the outlets 35*p* discharge the outside air introduced into the hollow portion 35*l* (first ventilation channel) so as to impinge on the cartridges P. In addition, three of the outlets 35*p* are disposed at locations opposing and between individual adjacent cartridges P supported on the tray 35 in a transverse direction (i.e., a direction perpendicular to the above-mentioned longitudinal direction) of each cartridge P, and the remaining one of the outlets 35*p* is disposed at a location opposing and between the rear frame 35*c* and the cartridge PY. Here, note that the rear frame 35*c* is a member forming part of the tray 35, and is disposed at a downstream side in a direction in which the tray 35 moves from an outer side position O outside of the apparatus main body 100*a* to an inner side position I inside thereof. In addition, the outlets 35*p* are individually disposed at one end side of the longitudinal direction of each cartridge P supported on the tray 35.

According to this embodiment, the gaps g are disposed at opposite sides of each cartridge P(opposite sides in the above-mentioned transverse direction) along the longitudinal direction of each cartridge P (i.e., the longitudinal direction of each photosensitive drum 1) supported on the tray 35. Accordingly, the individual cartridges P are each cooled from the opposite sides thereof, so they can be cooled in an efficient manner.

Then, after cooling the individual cartridges P, the outside air comes from openings 35*t* formed in the left frame 35*d* into the hollow portion 35*l* in the left frame 35*d* while passing through branch hollow portions 35*u* branching from the hollow portion 35*l*. Thereafter, the outside air is discharged from the rear side of the image forming apparatus 100 to the outside of the apparatus 100 through the opening portion 35*q*.

Here, note that in this second embodiment, the tray 35 does not have the partition plates 35*f* provided in the first embodiment. Instead, air is caused to flow through the gaps g generated by the absence of the partition plates 35*f*. Here, note that in this embodiment, appropriate marks (not shown) are attached to the upper surfaces of the left frame 35*d* and the right frame 35*e*, respectively. With such an arrangement, each cartridge P can be mounted (supported) to a prescribed position of the tray 35 even in the absence of the partition plates 35*f*.

Here, note that a construction can be adopted in which the outside air discharged from the outlets 35*p* is caused to first pass through the gaps g between individual adjacent cartridges P, and then to flow in an upward direction. In this case, for example, similar to the case of the above-mentioned first embodiment, it can be constructed such that an exhaust hole (not shown) is formed in a top cover having a discharge tray 25 on the upper surface of the apparatus main body, so that the outside air is discharged to the outside of the apparatus main body from the exhaust hole. With such a construction, a scanner unit 11 arranged above the cartridges P can be cooled, too. In addition, in case where such a construction is adopted, the ventilation channel in the left frame 35*d* is unnecessary.

Here, note that according to the above-mentioned modified embodiment, the image forming apparatus 100 has the following construction.

The image forming apparatus 100 has a tray 35 which is movable between an inner side position I located inside of the apparatus main body 100*a* and an outer side position O located outside of an apparatus main body 100*a*, while supporting cartridges P. Here, note that the inner side position I is in the inside of an opening portion 30, and the outer side position O is at the outside of the opening portion 30. The tray 35 has hollow portions 35*j*, 35*l* (the first embodiment and the second embodiment) that are a first ventilation channel through which outside air passes, gaps g (the second embodiment) and branch hollow portions 35*u* (the second embodiment). The tray 35 has an inlet 35*n* that serves to introduce outside air into the hollow portion 35*l* (first ventilation channel). In addition, the tray 35 also has outlets 35*p* for discharging the outside air introduced into the hollow portion 35*l* toward the cartridges P (so as to impinge on the cartridges P).

Moreover, the apparatus main body 100*a* (the main frame 80) has an air vent 96 (a ventilation channel and a second ventilation channel) formed therein to take in air from outside of the apparatus main body into the interior of the apparatus main body. In a state where the cartridge tray 35 has moved the cartridges P to the image forming operation position X located at the inner side position I, the inlet 35*n* is arranged at a position opposing an opening portion 97 of the air vent 96 at an apparatus main body internal side. In addition, the tray 35 is constructed such that the plurality of cartridges P can be attached to and detached from the tray 35. Also, the tray 35 has outlets 35*p* formed separately for individual cartridges P, respectively. Further, the tray 35 has partition portions 35*f* which serve to partition adjacent cartridges P from each other. The partition portions 35*f* are each provided with outlets 35*p*. Accordingly, the cartridges P can be cooled in a more efficient manner.

Here, note that the ventilation channels may not be the hollow portions which are shown in the above-mentioned respective embodiments. For example, a filter for removing airborne or suspended dust can be provided in a hollow portion. The ventilation channels are not limited to the hollow portions but instead may have any construction that enables air to pass therethrough.

According to the above-mentioned respective embodiments, it is possible to cool the cartridges in an effective manner.

In addition, according to the above-mentioned respective embodiments, it is possible to cool the cartridges in an effective manner, without increasing the number of component parts required.

Further, according to the above-mentioned respective embodiments, a cartridge support member, being movable between the inner side position and the outer side position of the apparatus main body while supporting the cartridges, is able to be used for cooling the cartridges.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-268978, filed on Oct. 17, 2008, which is hereby incorporated by reference in its entirety.

What is claimed is:

1. An electrophotographic image forming apparatus whose apparatus main body detachably mounts a process cartridge having an electrophotographic photosensitive drum and a process unit acting on said electrophotographic photosensitive drum, so that an image is formed on a recording medium, said apparatus comprising:

a cartridge support member, which is movable between an inner side position located inside of said apparatus main body and an outer side position located outside of said apparatus main body while supporting said process cartridge, and said cartridge support member has a first ventilation channel through which outside air passes, an inlet that introduces said outside air introduced into said first ventilation channel, and an outlet through which said outside air introduced into said first ventilation channel is discharged so as to impinge on said process cartridge;

a fan provided on said apparatus main body, and which takes-in the outside air into said apparatus main body from the outside of said apparatus main body;

a second ventilation channel formed in said apparatus main body to introduce therein the outside air which has been taken-in by the fan;

a sealing member provided on a first opening edge of said inlet so as to prevent the leakage of air from a part where said second ventilation channel and said first ventilation channel are connected with each other;

an apparatus opening portion formed in said apparatus main body, through which said cartridge support member passes so that said cartridge support member is allowed to move between the inner side position and the outer side position of said apparatus main body;

an opening and closing member for opening and closing the apparatus opening portion; and a support member which supports said cartridge support member to be slidably movable thereon, and which is interlocking with an opening and closing operation of said opening and closing member, wherein said inlet is arranged at a position opposing an opening portion of said second ventilation channel at an apparatus main body internal side, in the state where said cartridge support member has caused the process cartridge to move to an image forming operation position, which is the inner side position, at which the process cartridge performs an image forming operation;

the first opening edge is connected to a second opening edge of said opening portion of said second ventilation channel at said apparatus main body internal side, with the sealing member interposed therebetween, in a state where said cartridge support member has moved said process cartridge to said image forming operation portion; and said cartridge support member is so structured that, by said support member which is interlocking with the opening and closing operation of said opening and closing member, and by the closing operation of said opening and closing member, it is caused to move in a direction where said inlet and said opening portion of said second ventilation channel at said apparatus main body internal side are brought into contact with each other, and by the opening operation of the opening and closing member, said cartridge support member is caused to move in a direction of separating said inlet and said opening portion of said second ventilation channel at said apparatus main body internal side from each other, while keeping their positions in opposition to each other of said inlet and said opening portion of said second ventilation channel at said apparatus main body internal side.

2. The electrophotographic image forming apparatus as set forth in claim 1, further comprising a member in said apparatus main body to which a developer image formed on said electrophotographic photosensitive drum is transferred, and wherein the image forming operation position is a position in which said electrophotographic photosensitive drum is in contact with said member.

3. The electrophotographic image forming apparatus as set forth in claim 2, wherein said support member causes said cartridge support member to move, whereupon said inlet is caused to move in a direction of contacting with said opening portion of said second ventilation channel inside said apparatus main body and also in a direction wherein said electrophotographic photosensitive drum is in contact with said member to which a developer image formed on said electrophotographic photosensitive drum is to be transferred, by the closing operation of said opening and closing member, and said inlet is caused to move away from said opening portion of said second ventilation channel inside said apparatus main body and also in a direction where the electrophotographic photosensitive drum is caused to move away from said member to which a developer image formed on said electrophotographic photosensitive drum is to be transferred, by the opening operation of said opening and closing member, while said inlet and said opening portion of said second ventilation at said apparatus main body internal side are maintained at the positions in opposition to each other.

4. The electrophotographic image forming apparatus as set forth in claim 1, wherein said cartridge support member is constructed to detachably mount a plurality of said process cartridges, and a plurality of said outlets are provided in said cartridge support member each of which is provided for a different one of the process cartridges.

5. The electrophotographic image forming apparatus as set forth in claim 4, wherein said cartridge support member is provided with a partition portion which partitions adjacent process cartridges, and each partition portion has said outlet formed therein.

6. The electrophotographic image forming apparatus as set forth in claim 4, wherein said plurality of outlets are disposed at a plurality of locations along a longitudinal direction of each cartridge supported by said cartridge support member.

7. The electrophotographic image forming apparatus as set forth in claim 4, wherein outlets of said plurality of outlets are disposed at a location opposing and between adjacent cartridges supported by said cartridge support member in a transverse direction of each cartridge supported by said cartridge support member, and one outlet of said plurality of outlets is disposed at one end side of the longitudinal direction of each cartridge supported by said cartridge support member.

8. The electrophotographic image forming apparatus as set forth in claim 1, wherein said cartridge support member detachably supports a plurality of said process cartridges having developer of colors different from one another contained therein, and said electrophotographic image forming apparatus is a full color electrophotographic image forming apparatus.

9. An electrophotographic image forming apparatus whose apparatus main body detachably mounts a process cartridge having an electrophotographic photosensitive drum and a process unit acting on said electrophotographic photosensitive drum, so that an image is formed on a recording medium, said apparatus comprising:

a cartridge support member, which is movable between an inner side position located inside of said apparatus main body and an outer side position located outside of said apparatus main body while supporting said process cartridge, and said cartridge support member has a first ventilation channel through which outside air passes, an inlet that introduces said outside air into said first ventilation channel, and an outlet through which said outside air introduced into said first ventilation channel is discharged so as to impinge on said process cartridge;

a fan provided on said apparatus main body, and which takes-in the outside air into said apparatus main body from the outside of said apparatus main body;

a second ventilation channel formed in said apparatus main body to introduce therein the outside air which has been taken-in by the fan;

an apparatus opening portion formed in said apparatus main body, through which said cartridge support member passes so that said cartridge support member is allowed to move between the inner side position and the outer side position of said apparatus main body;

an opening and closing member for opening and closing the apparatus opening portion; and a support member which supports said cartridge support member to be slidably movable thereon, and which is interlocking with an opening and closing operation of said opening and closing member, wherein said inlet is arranged at a position opposing an opening portion of said second ventilation channel at an apparatus main body internal side, in the state where said cartridge support member has caused the process cartridge to move to an image forming operation position, which is the inner side position, at which the process cartridge performs an image forming operation;

a sealing member is provided on a second opening edge of said opening portion of said second ventilation channel on said apparatus main body internal side to prevent the leakage of air from a part where said second ventilation channel and said first ventilation channel are connected with each other;

a first opening edge of said inlet is structured to be connected to the second opening edge, with the sealing member interposed therebetween, in the state where said cartridge support member has moved said process cartridge to said image forming operation portion; and said cartridge support member is so structured that, by said support member which is interlocking with the opening and closing operation of said opening and closing member, and by the closing operation of said opening and closing member, it is caused to move in a direction where said inlet and said opening portion of said second ventilation channel at said apparatus main body internal side are brought into contact with each other, and by the opening operation of the opening and closing member, said cartridge support member is caused to move in a direction of separating said inlet and said opening portion of said second ventilation channel at said apparatus main body internal side from each other, while keeping their positions in opposition to each other of said inlet and said opening portion of said second ventilation channel at said apparatus main body internal side.

* * * * *